US007738324B2

(12) United States Patent
Noguchi

(10) Patent No.: US 7,738,324 B2
(45) Date of Patent: Jun. 15, 2010

(54) DISPLAY DEVICE AND TIMEPIECE CALENDAR DEVICE

(75) Inventor: Kazuo Noguchi, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 415 days.

(21) Appl. No.: 11/887,545

(22) PCT Filed: Mar. 29, 2006

(86) PCT No.: PCT/JP2006/306583

§ 371 (c)(1),
(2), (4) Date: Oct. 1, 2007

(87) PCT Pub. No.: WO2006/106787

PCT Pub. Date: Oct. 12, 2006

(65) Prior Publication Data

US 2009/0303841 A1 Dec. 10, 2009

(30) Foreign Application Priority Data

Mar. 30, 2005 (JP) ..... 2005-099724

(51) Int. Cl.
*G04B 19/20* (2006.01)

(52) U.S. Cl. ..... 368/221; 368/37; 368/233

(58) Field of Classification Search ..... 368/35–40, 368/28, 220–222, 233
See application file for complete search history.

(56) References Cited

U.S. PATENT DOCUMENTS

| | | | | |
|---|---|---|---|---|
| 15,637 | A * | 9/1856 | Allen | 368/37 |
| 368,961 | A * | 8/1887 | Morton | 368/37 |
| 3,518,825 | A * | 7/1970 | Nissen | 368/37 |
| 5,218,578 | A | 6/1993 | Perucchi | |
| 6,738,316 | B2 * | 5/2004 | Gabathuler et al. | 368/28 |
| 6,925,032 | B2 | 8/2005 | Willemin | |
| 6,934,221 | B2 | 8/2005 | Willemin | |
| 7,366,058 | B2 * | 4/2008 | Marki et al. | 368/220 |
| 2005/0174891 | A1 * | 8/2005 | Besse | 368/37 |

FOREIGN PATENT DOCUMENTS

| | | | |
|---|---|---|---|
| CH | 660941 | A | 6/1987 |
| CH | 695 225 | A5 | 1/2006 |
| DE | 19845539 | A | 4/2000 |
| EP | 1 536 300 | A1 | 6/2005 |

(Continued)

*Primary Examiner*—Vit W Miska
*Assistant Examiner*—Sean Kayes
(74) *Attorney, Agent, or Firm*—Dickstein Shapiro LLP

(57) ABSTRACT

A display device and a timepiece calendar device capable of large display of letters and numbers is provided, which can be simplified and reduced in size. The display device comprises a first display wheel having a denotation portion for showing information about a part of a period and a toothed portion including a plurality of teeth to be driven. The device also has a second display wheel having a denotation portion for showing a part of the period other than the part of the period shown by the first display wheel, an opening via which the first display wheel is exposed, and a toothed portion including a plurality of teeth to be driven, and placed overlapping the first display wheel. The device also has a driving finger for driving the first display wheel and the second display wheel to rotate.

34 Claims, 26 Drawing Sheets

FOREIGN PATENT DOCUMENTS

| | | | |
|---|---|---|---|
| FR | 849199 | A | 11/1939 |
| GB | 957031 | A | 5/1964 |
| JP | 50-786 | B1 | 1/1975 |
| JP | 2005-156562 | A | 6/2005 |
| JP | 2005-156563 | A | 6/2005 |

* cited by examiner

DISPLAY DEVICE AND TIMEPIECE CALENDAR DEVICE

TECHNICAL FIELD

The present invention relates to a display device and a timepiece calendar device, and in particular to a display device and a timepiece calendar device capable of display in larger letters and/or numbers.

BACKGROUND ART

In the following, a case in which date calendar information is displayed in a timepiece in larger numbers, using a timepiece calendar device as an example of a display device, is described.

Conventionally, for large display of a calendar in a calendar window, two date dials are used to display the calendar such that the calendar letters on the respective date dials are shown in the calendar window defined on the dial. Specifically, an arrangement in which one of the two date dials is advanced while the other is kept still and, thereafter, the other is advanced while the one is kept still makes it possible to display the letters on the two date dials. This is disclosed in Swiss Patent No. CH 660941 B5 (see FIGS. 1 and 3).

This concept is disclosed also in Japanese Patent Laid-Open Publications Nos. 2005-156562 (FIGS. 4, 5, and 6) and 2005-156563 (FIGS. 2, 3, and 4), both disclosed later than the priority date of this application.

The above-described three patent documents are common in that the upper date dial of the two date dials has sixteen sectors, while the lower date dial has seventeen sectors. Accordingly, the upper and lower date dials have different numbers of teeth in the toothed portion, with the upper date dial having sixteen teeth and the lower date dial having seventeen teeth. The difference of one tooth results in a difference (displacement) in positional relationship in a plan view between the teeth of the upper and lower date dials.

Thus, as disclosed in Swiss Patent No. CH 660941 B5 (FIG. 1), Japanese Patent Laid-Open Publication Nos. 2005-156562 (FIG. 7) and 2005-156563 (FIG. 5), both disclosed later than the priority date of this application, two date jumpers in two shapes mounted in different positions in a plan view are necessary, one shape for the upper date dial and the other shape for the lower date dial. This results in the need for a wider space and a complicated structure.

When a position where one tooth of the upper date dial overlaps in a plan view one tooth of the lower date dial is reserved for a drive wheel, a space for mounting a date corrector setting wheel cannot be ensured as no other such space where the tooth of the upper date dial overlaps the tooth of the lower date dial is available. Thus, initial CH 660941 B5 (FIG. 1) and Japanese Patent Laid-Open Publication No. 2005-156563 (FIG. 6), disclosed later than the priority date of the present application, make a proposal without a date correction mechanism. However, as a date correction mechanism is necessary to advance the date dial for date matching when the timepiece date becomes different from the current date at the end of a short month, at activation of the timepiece, or due to battery exchange, a proposal including no date correction mechanism is inconvenient as it makes a correction operation troublesome. Therefore, Japanese Patent Laid-Open Publication No. 2005-156562 (FIG. 8) discloses a two-toothed portion structure in which a toothed portion having different positions (pitches) is placed on the toothed portion of the lower date dial, the toothed portion to place. This results in the lower date dial having a complicated structure.

An object of the present invention is to propose a display device and a timepiece calendar display capable of large display of information and solving a conventional technical problem.

DISCLOSURE OF INVENTION

In order to address the above-described problem, according to one aspect of the present invention, there is provided a display device, comprising a first display wheel having a denotation portion for showing information about a part of a period and a toothed portion including a plurality of teeth to be driven; a second display wheel having a denotation portion for showing a part of the period other than the part of the period shown by the first display wheel, an opening via which the first display wheel is exposed, and a toothed portion including a plurality of teeth to be driven, and placed overlapping the first display wheel; and a driving finger for driving the first display wheel and the second display wheel to rotate, and further comprising a display wheel drive control portion for driving the first display wheel and the second display wheel, using the driving finger, every predetermined period of time, to thereby expose the denotation portion on one of the display wheels in a window to thereby display the information, wherein numbers of the teeth in the toothed portions of the first display wheel and of the second display wheel are the same. With the above, display which is easy to see, with information displayed in large characters, and size reduction and simplification of the structure, can be achieved.

Also, the display wheel drive control portion may comprises engagement state generation means for generating a first engagement state in which the driving finger is engaged with the toothed portion of the first display wheel but not with the toothed portion of the second display wheel when the denotation portion on the first display wheel displays the information about the part of the period in the window through the opening on the second display wheel, and for generating a second engagement state in which the driving finger is engaged with the toothed portion of the second display wheel but not with the toothed portion of the first display wheel when the denotation portion on the second display wheel displays the information about the other period in the window, and engagement state switching means for switching engagement states of the driving finger relative to the toothed portion of the first display wheel and the toothed portion of the second display wheel to thereby mutually switch the first engagement state and the second engagement state. With the display wheel drive control portion including the engagement state generation means for generating the first and second engagement states and the engagement state switching means, display which is easy to see with information displayed in large characters can be achieved, while reducing the size of and simplifying the structure.

Also, the engagement state generation means may be formed by an air swing generation portion for enabling the driving finger to air-swing with respect to one of the display wheels depending on whether or not a toothless portion formed on the toothed portion of at least one of the first display wheel and the second display wheel is located within a drive track of the driving finger, to thereby stop one of the first display wheel and the second display wheel, and drives only other display wheel. With the above, display which is easy to see with information displayed in large characters can be achieved, while reducing the size of and simplifying the structure.

Also, the engagement state generation means may be formed by an air swing generation portion for enabling the driving finger to air-swing with respect to one of the display wheels depending on whether or not a toothless portion formed on the toothed portion of at least one of the first display wheel and the second display wheel is located within a drive track of the driving finger, to thereby stop one of the first display wheel and the second display wheel, and drives only other display wheel, and the engagement state switching means may have concurrent drive means for concurrently driving the first display wheel and the second display wheel to thereby move the toothless portion located within the drive track of the driving finger. With the above, display which is easy to see with information displayed in large characters can be achieved, while reducing the size of and simplifying the structure.

Also, the toothed portion of the first display wheel may include seventeen teeth, the denotation portion on the first display wheel may have denotations of dates $17^{th}$ to $31^{st}$ and two information-free portions successively formed between the dates $17^{th}$ and $31^{st}$, and the toothed portion of the second display wheel may include seventeen teeth. The denotation portion of the second display wheel may have denotations of dates $1^{st}$ to $16^{th}$ and an opening formed between the dates $1^{st}$ and $16^{th}$, with the second display wheel alone being driven by the driving finger in feeding from the date $1^{st}$ to the date $15^{th}$. The first display wheel and the second display wheel may be concurrently driven in feeding from the date $15^{th}$ to the date $16^{th}$ and the date $16^{th}$ to $17^{th}$, and the first display wheel alone is driven by the driving finger in feeding from the date $17^{th}$ to the date $31^{st}$, and the first display wheel and the second display wheel may be concurrently driven in feeding from the date $31^{st}$ to the date $1^{st}$. With the above, display which is easy to see with information displayed in large characters and date denotations shown in succession, and size reduction and simplification of the structure, can be achieved.

In this case, the number of application of concurrent driving by the concurrent drive means may be a number obtained by adding one to a number of the information-free portion. With the above, display which is easy to see with information displayed in large characters and date denotations shown in succession, and size reduction and simplification of the structure, can be achieved.

Also, the toothless portion may be either a thin toothed portion with the tooth partially removed in a thickness direction of the toothed portion or a toothless portion with the tooth removed throughout an entire thickness of the toothed portion. With the above, display which is easy to see with information displayed in large characters can be achieved, while reducing the size of and simplifying the structure.

Also, the concurrent drive means may include a projection and a groove to be engaged with the projection, the projection and the groove being formed on the respective display wheels. With the above, display which is easy to see with information displayed in large characters can be achieved while reducing the size of and simplifying the structure.

Also, the driving finger may have a first driving finger for driving the toothed portion of the first display wheel and a second driving finger for driving the toothed portion of the second display wheel, and the engagement state generation means may be path switching means for causing the second driving finger to be displaced from a drive path to avoid engagement between the toothed portion of the second display wheel and the second driving finger, when the first driving finger drives the toothed portion of the first display wheel. With the above, display which is easy to see with information displayed in large characters, and size reduction and simplification of the structure, can be achieved.

Also, the first driving finger and the second driving finger may be driving fingers at least one of which has an abutment portion to abut on the toothed portion, and the path switching means may be a timepiece component which appears within a driving area of the driving finger during a predetermined period of time in which the toothed portion of the first display wheel is driven and contacts the abutment portion of the driving finger to thereby switch the drive path of the second driving finger to an avoidance path. With the above, size reduction and simplification of the structure is attained.

Also, the first driving finger and the second driving finger may be integrally formed. With the above, size reduction and simplification of the structure is attained.

Also, the timepiece component may be the toothed portion of the first display wheel. With the above, size reduction and simplification of the structure is attained.

Also, the toothed portion of the first display wheel and the toothed portion of the second display wheel may be formed so as to rotate along substantially identical paths, the first driving finger and the second driving finger may be formed so as to integrally drive for rotation around a predetermined rotational center as a reference, and an engagement portion of the first driving finger may be positioned closer to the toothed portion of the display wheel than an engagement portion of the second driving finger. With the above, the structure can be further simplified.

Also, the toothed portion of the first display wheel and the toothed portion of the second display wheel may be formed so as to rotate along substantially identical paths, the first driving finger and the second driving finger may be formed so as to integrally drive for rotation around a predetermined rotational center as a reference, and a length from the predetermined rotational center to an engagement portion of the first driving finger may be defined longer than a length from the predetermined rotational center to an engagement portion of the second driving finger. With the above, similarly, the structure can be further simplified.

Also, the toothed portion of the first display wheel, which is located in the drive path of the first driving finger corresponding to a predetermined period of time in which the second driving finger drives the toothed portion of the second display wheel, may be provided with a toothless portion for enabling air-swing with respect to the toothed portion to avoid engagement with the first driving finger. With the above, the structure can be simplified.

Also, the abutment portion of the first driving finger may be inserted into the toothless portion, whereby the second driving finger is located in the drive path for engagement with the toothed portion of the second display wheel. With the above, a simplified structure can be achieved.

Also, the driving finger may have a long hole for enabling a predetermined shaft to change a rotational center position thereof, and may be urged by a spring member toward the toothed portions of the first display wheel and the second display wheel. With the above, an ensured operation can be attained with a simpler structure.

Also, there can be provided a display device having a corrector setting wheel having a driving finger for toothed portion of the display wheel. With the above, a correction mechanism can be realized.

Also, the driving finger of the corrector setting wheel may include a third driving finger for correctively driving the toothed portion of the first display wheel and a fourth driving finger for correctively driving the toothed portion of the second display wheel, and may be formed integrally driving for rotation around a predetermined rotational center as a reference, in which an engagement portion of the third driving finger is positioned closer to the toothed portion of the display wheel than an engagement portion of the fourth driving finger. With the above, correctively drive can be realized using a simple structure.

Also, the driving finger of the corrector setting wheel may include a third driving finger for correctively driving the toothed portion of the first display wheel and a fourth driving finger for correctively driving the toothed portion of the second display wheel, and may be integrally formed and rotatably driving around a predetermined rotational center as a reference, in which a length from the predetermined rotational center to an engagement portion of the third driving finger is defined longer than a length from the predetermined rotational center to an engagement portion of the fourth driving finger. With the above, similarly, corrective driving can be realized using a simple structure.

Also, the toothed portion of the first display wheel, which is located in the drive path of the third driving finger corresponding to a predetermined period of time during which the fourth driving finger drives, for correction, the toothed portion of the second display wheel, may be provided with a toothless portion for avoiding engagement with the third driving finger. With the above, the structure for corrective drive can be simplified.

Also, an abutment portion to abut on the toothed portion may be provided on at least one of the third driving finger and the fourth driving finger. With the above, the structure for corrective driving can be simplified.

Also, the abutment portion of the third driving finger may be inserted into the toothless portion whereby the fourth driving finger is introduced to the drive path for engagement with the toothed portion of the second display wheel. With the above, the structure for corrective driving can be simplified.

Also, the third driving finger and the fourth driving finger may each have a reversal mechanism for enabling a predetermined shaft to change a rotational center position thereof. With the above, the structure for corrective driving can be simplified.

Also, the first display wheel may have a first toothless portion for avoiding engagement with the first driving finger and a second toothless portion for avoiding engagement with the third driving finger. With the above, alignment between the driving structure and the correction driving structure of the display wheel can be attained using a simple structure.

Also, the first toothless portion may be formed on an upper surface side of the toothed portion of the first display wheel, and the second toothless portion may be formed on a lower surface side of the toothed portion of the first display wheel. With the above, matching between the driving structure and the correction driving structure of the display wheel can be attained using a simple structure.

Also, the toothed portion of the first display wheel may include sixteen teeth, the denotation portion on the first display wheel may have denotations of dates $16^{th}$ to $31^{st}$, the toothed portion of the second display wheel may include sixteen teeth, the denotation portion of the second display wheel may have denotations of dates $1^{st}$ to $15^{th}$ and the opening formed between the dates $1^{st}$ and $15^{th}$, the first driving finger may air-swing with respect to the first toothless portion of the first display wheel and the second driving finger drives only the second display wheel in feeding from the date $1^{st}$ to the date $15^{th}$, the concurrent drive means may concurrently drive the first display wheel and the second display wheel in feeding from the date $15^{th}$ to the date $16^{th}$, the abutment portion may abut on the toothed portion of the first display wheel, so that the second driving finger is apart from the toothed portion of the second display wheel, and only the first display wheel is driven by the first driving finger, in feeding from a date $17^{th}$ to a date $31^{st}$, and the abutment portion and the first driving finger may be inserted into the first toothless portion with only the second display wheel being driven by the second driving finger in feeding from the date $31^{st}$ to the date $1^{st}$.

With the above, display which is easy to see with information displayed in large characters, and size reduction and simplification of a structure, can be attained, and alignment between the driving structure and the correction driving structure of the display wheel can be attained using a simple structure.

Also, the toothed portion of the first display wheel may include sixteen teeth, the denotation portion on the first display wheel may have denotations of a date $16^{th}$ to a date $31^{st}$, the toothed portion of the second display wheel may include sixteen teeth, the denotation portion of the second display wheel may have denotations of a date $1^{st}$ to a date $15^{th}$ and the opening formed between the date $1^{st}$ and the date $15^{th}$, the third driving finger air-swings with respect to the second toothless portion, and the fourth driving finger may drive only the second display wheel in correction from the date $1^{st}$ to the date $15^{th}$, the concurrent drive means may concurrently drive the first display wheel and the second display wheel in correction from the date $15^{th}$ to the date $16^{th}$, the abutment portion may abut on the toothed portion of the first display wheel, so that the fourth driving finger is apart from the toothed portion of the second display wheel, and only the first display wheel is driven by the third driving finger, in correction from the date $17^{th}$ to the date $31^{st}$, and the abutment portion and the third driving finger may be inserted into the second toothless portion and only the second display wheel is driven by the fourth driving finger in correction from the date $31^{st}$ to the date $1^{st}$.

With the above, display which is easy to see with information displayed in large characters, and size reduction and simplification of a structure, can be attained, and matching between the driving structure and the correction driving structure of the display wheel can be attained using a simple structure.

Also, when the display device is a timepiece calendar device, display which is easy to see with large calendar display, and size reduction and simplification of the structure, can be attained.

BEST MODE FOR CARRYING OUT THE INVENTION

In the following, embodiments of the present invention will be described with reference to the accompanying drawings.

First Embodiment

FIGS. 1 to 15 relate to a first embodiment.

Figure 1:
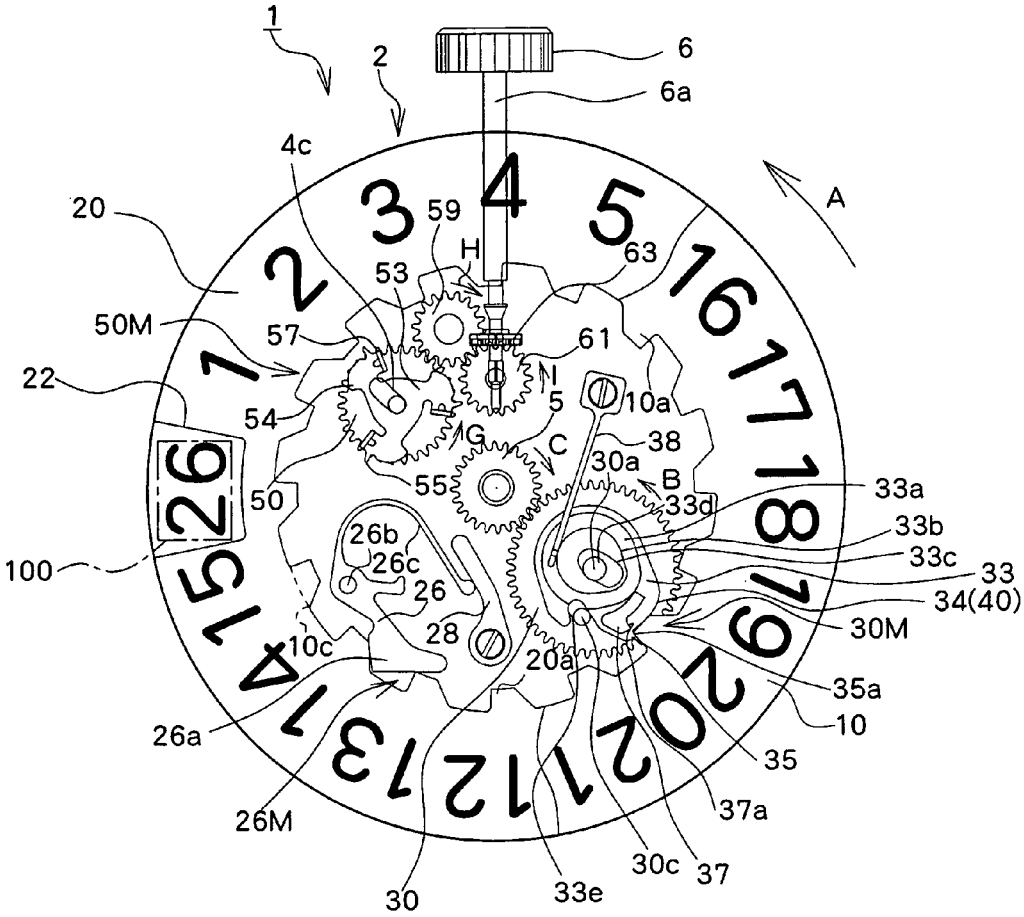
FIG. 1 is a plan view of a complete timepiece calendar device as a display device in a first embodiment of the present invention, with a dial removed and a second date indicator (an upper date indicator) partially cut away, showing a first date indicator (a lower date indicator) in a normal display state, a corrector setting wheel in a not-operating state, and a calendar window defined on a dial located at the position of 12 o'clock (that is, the letter "26" described on the first date indicator in FIG. 1 shown) in this example.

(1) FIG. 1 is a plan view of a complete timepiece calendar device according to the first embodiment of the present invention, in which a dial and a holder plate are removed and a second date indicator (an upper date indicator here) is partially cut away.

The calendar device 2 of the timepiece 1 in this embodiment comprises a first date indicator 10 as a first display wheel, a second date indicator 20 as a second display wheel, a date jumper mechanism 26M, a date indicator drive control portion (a date indicator driving mechanism in this example) 30M, and a date correction mechanism 50M, in which the first date indicator 10 and the second date indicator 20 are placed one on top of the other.

Figure 2:
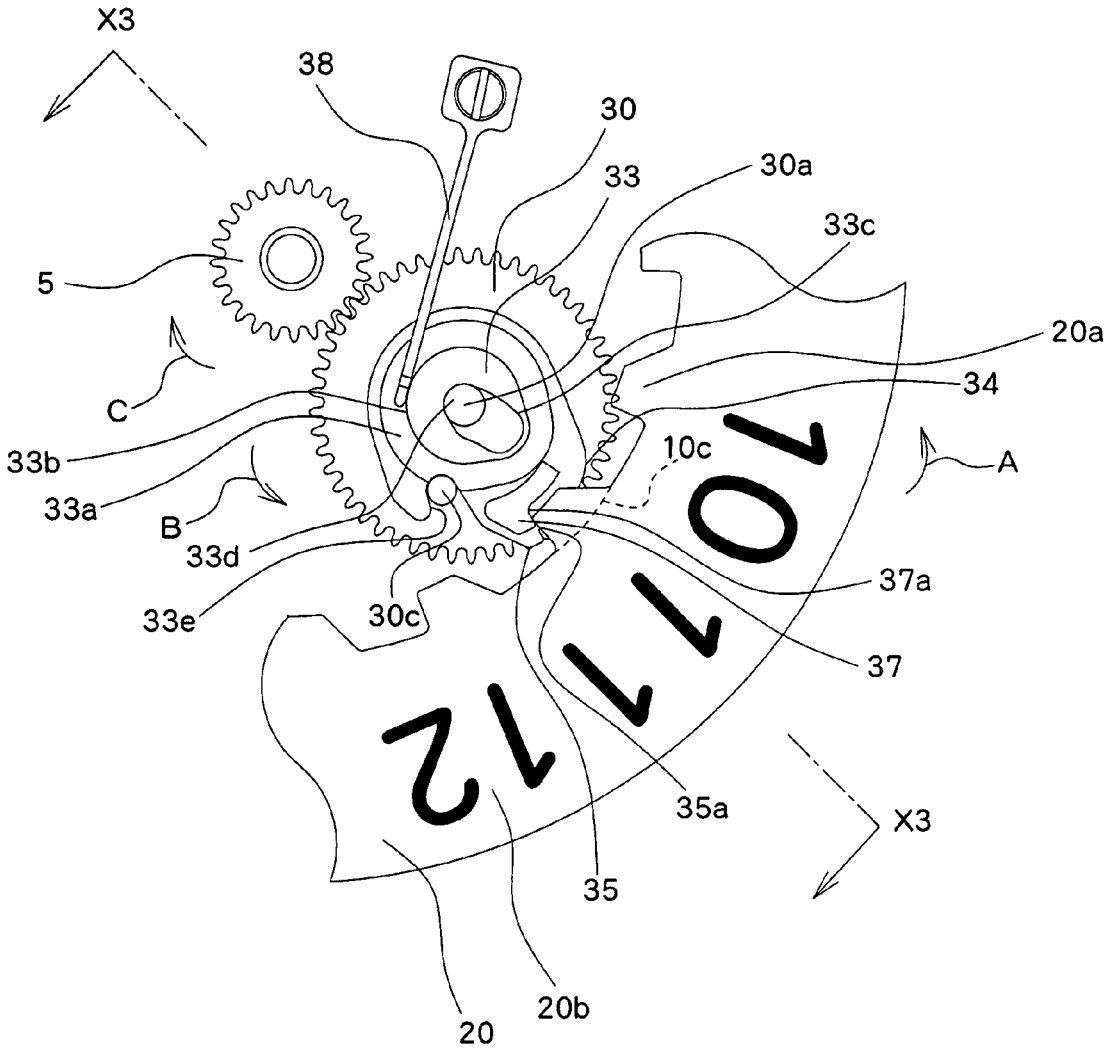
FIG. 2 is a partial plan view of the timepiece calendar device in FIG. 1, showing a second date indicator in a normal driving state.
Figure 3:
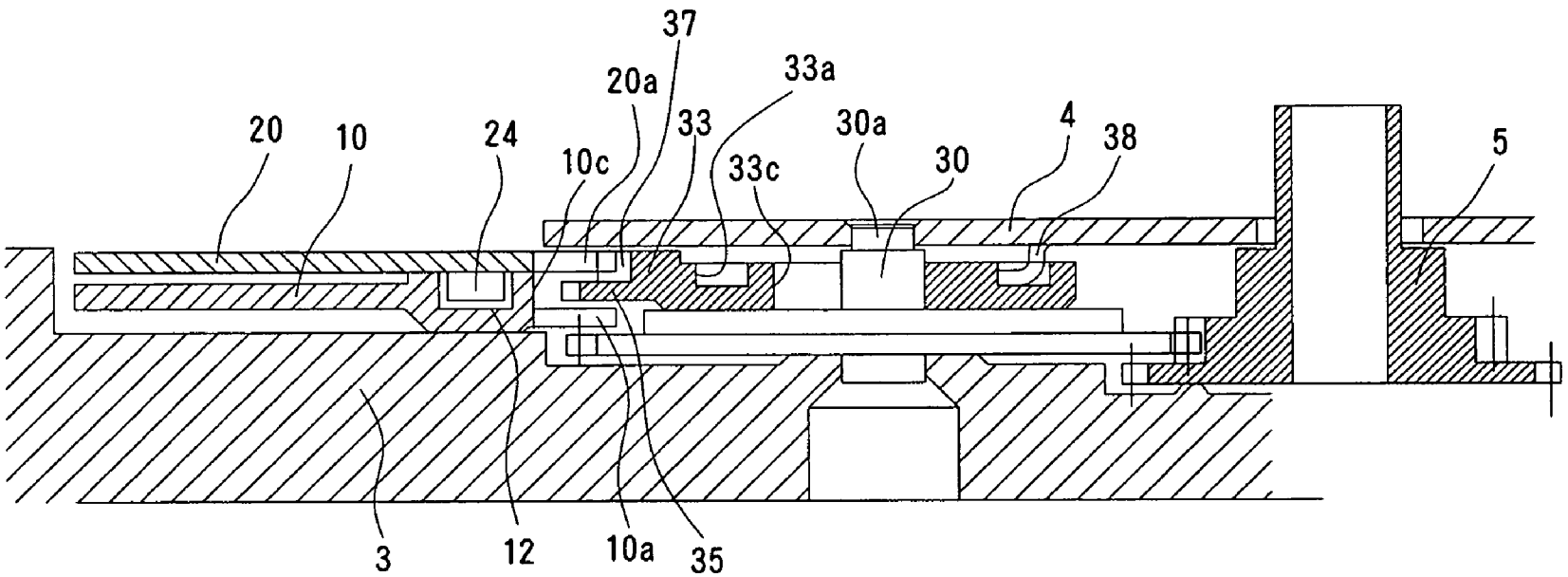
FIG. 3 is a cross sectional view along the line X3-X3 in FIG. 2.
Figure 4:
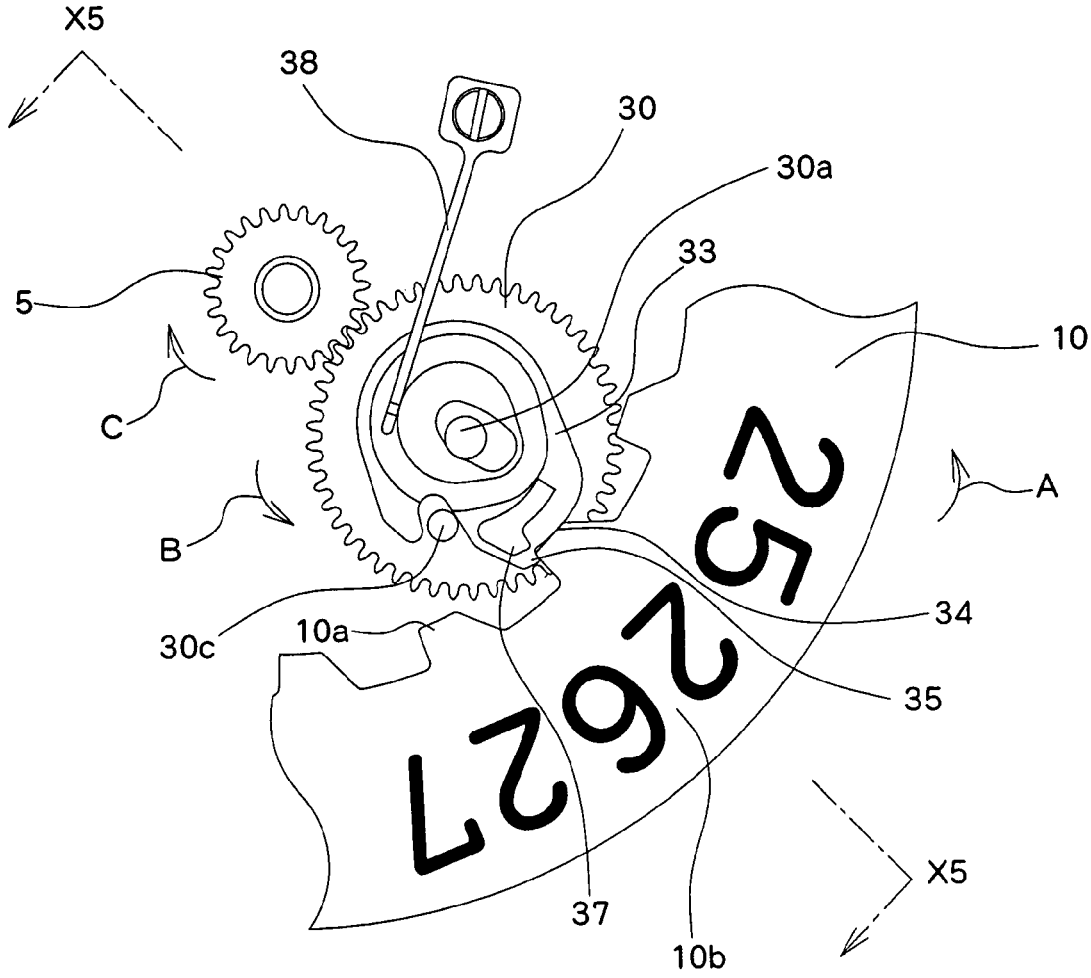
FIG. 4 is a partial plan view of the timepiece calendar device in FIG. 1, with the first date indicator in a normal driving state.
Figure 5:
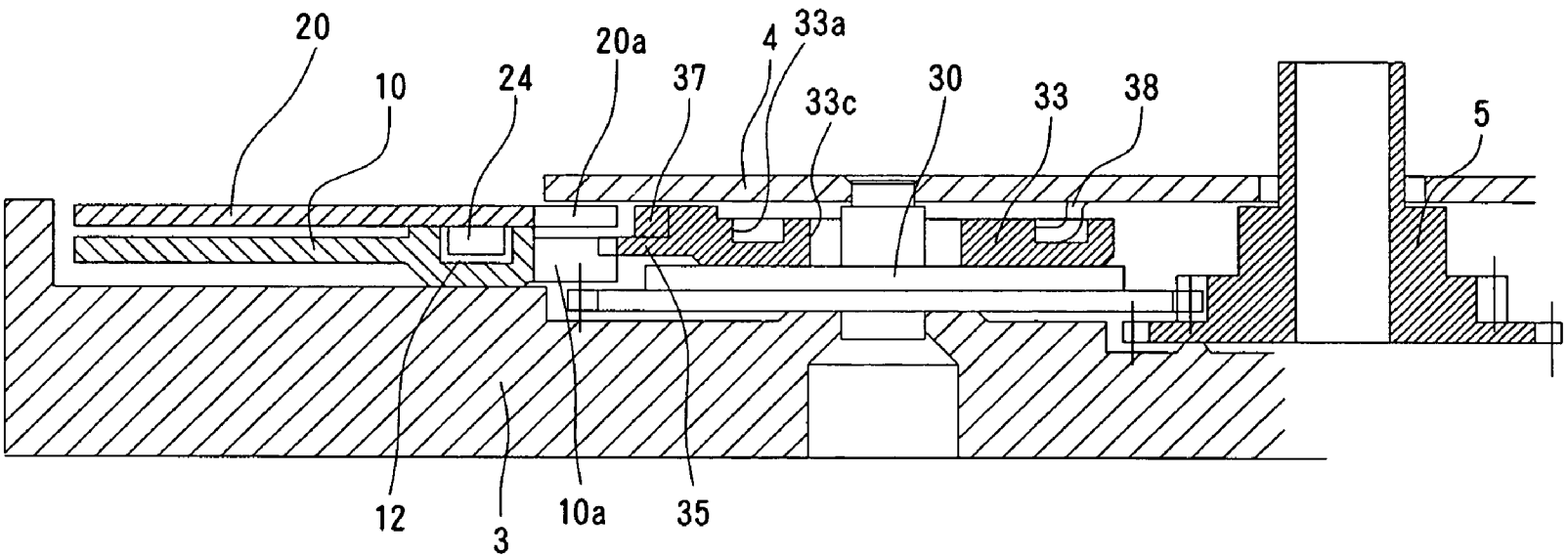
FIG. 5 is a cross sectional view along the line X5-X5 in FIG. 4.

(2) Initially, with reference to FIGS. 1 to 5, structures of the date indicators 10, 20, the date jumper mechanism 26M, and the date indicator drive control portion (the date indicator driving mechanism in this example) 30M in this embodiment will be described. FIG. 1 is a plan view of a complete timepiece calendar device, showing the first date indicator 10 (the lower date indicator here, and the same applies in the following) in a normal driving state and the corrector setting wheel 50 in a not-operating state. The display window (a window on the dial, referred to as a calendar window) 100 defined on the dial is located at the position of twelve o'clock (that is, where the number "26" on the first date indicator 10 is shown in FIG. 1) in this example. FIG. 2 is a partial plan view of the timepiece calendar device shown in FIG. 1, showing the second date indicator 20 (the upper date indicator here, same in the following) in a normal driving state. FIG. 3 is a cross sectional view along the line X3-X3 in FIG. 2. FIG. 4 is a partial plan view of the timepiece calendar device shown in FIG. 1, showing the first date indicator 10 in a normal driving state. FIG. 5 is a cross sectional view along the line X5-X5 in FIG. 4. In the cross sectional views of FIGS. 3 and 5 (also, FIGS. 13 and 15), a holder plate 4 for pressing the date indicator or the like is shown.

(a) First Date indicator 10, Second Date indicator 20

The first date indicator 10 and the second date indicator 20 are placed on the other. The annular first date indicator 10 has, on the front surface thereof, a denotation portion 10*b* showing a partial period of a calendar and a toothed portion 10*a* to be driven. The annular second date indicator 20 (an upper date indicator) has, on the front surface thereof, a denotation portion 20*b* showing a partial period of the calendar, other than that which is shown on the first date indicator 10, an opening 22 via which to expose the first date indicator 10, and a toothed portion 20*a* to be driven. The toothed portions 10*a*, 20*a* of the first date indicator 10 and the second date indicator 20, respectively, are formed so as to rotate along identical paths in a plan view (the paths are shown completely overlapped in a plan view in this embodiment).

With the date indicators in this embodiment, the first date indicator (the lower date indicator) 10 has, on the upper surface side thereof, date denotations from the $16^{th}$ to the $31^{st}$, and a partially disconnected groove, or an arc groove 12 here (schematically shown in a plan view in FIGS. 6 to 10), while the second date indicator (the upper date indicator) 20 has date denotations from the $1^{st}$ to the $15^{th}$, an opening 22, and a projection 24 to be inserted into the arc groove 12 of the first date indicator 10. In this example, engagement state switching means is constituted containing a concurrent drive means for the date indicators having the arc groove 12 and the projection 24, respectively.

It should be noted here that although the arc groove 12 is formed on the first date indicator 10 and the projection 24 is formed on the second date indicator 20 in this example, the arc groove 12 may be formed on the second date indicator 20 and the projection 24 may be formed on the first date indicator 10.

The toothed portion 10*a* of the first date indicator (the lower date indicator) 10 has a first toothless portion 10*c* for accepting a first driving finger 35 and a closer abutment portion 34 of a date indicator driving wheel 30, to be described later, when the denotation of the date $31^{st}$ is located below the display window 100 of the dial (shown in FIGS. 2 and 3). In shifting the denotations on the date indicators from the date $31^{st}$ to the date $1^{st}$, the first date indicator (the lower date indicator) 10 is not fed due to the presence of the first toothless portion 10*c*, and instead, the second driving finger 37 feeds the toothed portion 20*a* of the second date indicator (the upper date indicator) 20 such that the denotation of the date $1^{st}$ is shown. In this example, an air swing generation portion is formed containing the first toothless portion 10*c*.

As will be described later, in a relationship with the corrector setting wheel 50, similarly, the toothed portion 10*a* of the first date indicator (the lower date indicator) 10 has a second toothless portion 10*d* for accepting a third driving finger 55 and a closer abutment portion 54 when the denotation of the date $31^{st}$ is located below the display window (the window on the dial) 100 defined on the dial (shown in FIGS. 12 and 13). In correcting the denotations on the date indicators from the date $31^{st}$ to the date $1^{st}$, the first date indicator (the lower date indicator) 10 is not fed due to the presence of the second toothless portion 10*d*, and instead, the fourth driving finger 57 feeds the toothed portion 20*a* of the second date indicator (the upper date indicator) 20 such that the denotation of the date $1^{st}$ is shown. It should be noted that the first toothless portion 10*c* and the second toothless portion 10*d* of the first date indicator 10 each have a structure in which teeth are formed thin in the width direction, rather than removed, and thus teeth are present over the entire area of the toothless portions.

(b) Date Jumper Mechanism 26M

The date jumper mechanism 26M has two identically shaped date jumpers 26, 26, placed one on top of the other, for causing the two date indicators to jump. The date jumper mechanism 26M has date jumpers 26, 26 having mountain-like jumper portions 26*a*, 26*a* for contacting the toothed portion 10*a* of the first date indicator 10 and the toothed portion 20*a* of the second date indicator 20, respectively, and spring portions 26*c*, 26*c* extending on the other side relative to the rotational shaft 26*b*, and guard portions 28 fixed on the substrate (the main plate 3 here) and for abutting on the ends of the spring portions 26*c*, 26*c*. The date jumper mechanism 26M causes the first date indicator 10 and the second date indicator 20 to jump. As two identically shaped date jumpers 26, 26 are placed one on top of the other, as described above, the date jumpers 26, 26, and thus the date jumper mechanism 26M, can be formed smaller in size in a plan view. As the first toothless portion 10*c* and the second toothless portion 10*d* of the first date indicator 10 in this embodiment have teeth formed thin in the width direction, rather than removed, the date jumpers 26, 26 may be fit into one space between the teeth of the first date indicator 10 and that of the second date indicator 20, respectively. This makes possible the use of a date jumper having a general shape, rather than a special shape.

(c) Date Indicator Drive Control Portion (Date Indicator Driving Mechanism in this Example) 30M The date indicator drive control portion (the in this example) 30M comprises a date indicator driving wheel 30, a driving finger (a date dial driving finger here) 33, mounted on the date indicator driving wheel 30 and for driving the first date indicator 10 and the second date indicator 20 to rotate, and a path switching means 40 (here comprising an abutment portion 34, formed close to the date dial driving finger 33, and the toothed portion 10*a* of the first date indicator 10 for contacting the abutment portion 34). The driving finger (the date dial driving finger here) 33 causes the shaft 30*a* of the date indicator driving wheel 30 to be fitted into the long hole 33*c* and the pin 30*c* of the date indicator driving wheel 30 to be engaged with a stopper wall 33*e*. Further, the driving finger (the date dial driving finger here) 33 comprises a first driving finger 35 for driving the toothed portion 10*a* of the first date indicator 10, a second driving finger 37 for driving the toothed portion 20*a* of the second date indicator 20, both fingers 35, 37 being integrally formed, and an abutment portion 34, or a part of the path switching means 40, as described above.

When the second date indicator 20 is placed on the first date indicator 10 and the date indicators are alternatively driven for a predetermined period of time, the front surface of one of the date indicators is exposed through the window 100 defined on the dial to thereby display the calendar. When the first driving finger 35 drives the toothed portion 10*a* of the first date indicator 10, the path switching means 40 causes the second driving finger 37 to be displaced from the drive path to thereby avoid engagement with the toothed portion 20*a* of the second date indicator 20. This is the first engagement state. The path switching means 40 is a timepiece component (the toothed portion 10*a* of the first date indicator 10, as described above, in this example) which appears in the driving area of the driving finger 33 during a predetermined period of time during which the toothed portion 10*a* of the first date indicator 10 is driven, and contacts the abutment portion 34 of the driving finger 33 to switch the drive path of the second driving finger 37 to the avoidance path.

The toothed portions 10*a*, 20*a* of the first date indicator 10 and the second date indicator 20 are formed so as to rotate along substantially identical paths (the paths are shown completely overlapped in a plan view here). The first driving finger 35 and the second driving finger 37 are integrally formed so as to be rotatably driven around a predetermined rotational center (which is tentatively indicated as 33*d* in FIG. 1, but moves in the long hole 33*c*). The engagement portion 35*a* of the first driving finger 35 is located closer to the toothed portions 10*a*, 20*a* of the date indicators 10, 20 than the engagement portion 37*a* of the second driving finger 37. That is, the toothed portions 10*a*, 20*a* of the first date indicator 10 and the second date indicator 20 are formed so as to rotate along substantially identical paths; the first driving finger 35 and the second driving finger 37 are formed so as to integrally drive for rotation around a predetermined rotational center 33*d*; and the length from the predetermined rotational center 33*d* to the engagement portion 35*a* of the first driving finger 35 is defined longer than that from the predetermined rotational center to the engagement portion 37*a* of the second driving finger 37.

The toothed portion 10*a* of the first date indicator 10, which is located in the drive path of the first driving finger 35 corresponding to a predetermined period of time in which the second driving finger 37 drives the toothed portion 20*a* of the second date indicator 20, is provided with a first toothless portion 10*c* for avoiding engagement with the first driving finger 35 (indicated by the dot line in FIGS. 1 and 2). With the abutment portion 34 of the driving finger 33 inserted into the first toothless portion 10*c*, the second driving finger 37 is introduced into the drive path for engagement with the toothed portion 20*a* of the second date indicator 20. The first toothless portion 10*c* constitutes an air-swing generation portion for generating an air-swing by the first driving finger 35 and causing the second driving finger 37 to be engaged with the toothed portion 20*a* of the second date indicator 20. This is the second engagement state.

Therefore, in this example, the path switching means 40 having the toothless portion 10*c* and the abutment portion 34 and for causing the first driving finger 35 and the second driving finger 37 to be displaced from the driving path constitutes an engagement state generation means for generating the first engagement state and the second engagement state.

The engagement state switching means for switching the first and second engagement states has concurrent drive means for concurrently driving the first date indicator 10 and the second date indicator 20 to thereby move the first toothless portion 10*c* located in the drive tracks of the driving fingers 35, 37. The concurrent drive means causes the projection 24 of the second date indicator 20 to be engaged with the arc groove 12 of the first date indicator 10, and concurrently feeds the date indicators 10, 20 by utilizing the pressing/pulling relationship between the groove wall 14 of the arc groove 12 and the projection 24.

The driving finger 33 has a long hole 33*c* for enabling a predetermined shaft to change the rotational center position thereof, and is urged towards the toothed portions 10*a*, 20*a* of the first date indicator 10 and the second date indicator 20, respectively, by the spring member (a regulation spring here) 38. The regulation spring 38 has an end to be inserted into the long groove 33*a* defined on the driving finger (the date dial driving finger) 33 to thus press the interior wall 33*b* of the long groove to thereby urge the driving finger 33 towards the toothed portions 10*a*, 20*a*.

The first driving finger 35 and the second driving finger 37 may be formed separate. In order to separately form the first driving finger 35 and the second driving finger 37, it may be arranged such that the rotational centers of the first driving finger 35 and the second driving finger 37 are separately formed on the date indicator driving wheel 30. Alternatively, it may be arranged such that the first driving finger 35 may be mounted on the date indicator driving wheel 30 such that the shaft 30*a* is inserted into the long hole 33*c* and that the second driving finger 37 is engaged with the shaft, mounted on the first driving finger 35 and serving as the rotational center. The abutment portion 34 may be provided to at least one of the first driving finger 35 and the second driving finger 37.

(3) In the following, with reference to FIGS. 1 to 5, a basic operation of the first date indicator 10, the second date indicator 20, and the date indicator drive control portion (the date indicator driving mechanism in this example) 30M will be described.

As shown in FIGS. 2 and 3, with the second date indicator (the upper date indicator) 20 in a normal driving state, the date indicator driving wheel 30 receives a driving force from the hour wheel 5 rotating in the direction indicated by the arrow C, and thus rotates in the direction indicated by the arrow B. The date dial driving finger (the driving finger) 33, mounted on the date indicator driving wheel 30 and having the long hole 33*c*, also rotates in the direction B. With the second date indicator (the upper date indicator) 20 in a normal driving state, as the abutment portion 34 and the first driving finger 35 are inserted into the first toothless portion 10*c* of the toothed portion 10*a* of the first date indicator 10, the toothed portion 20*a* of the second date indicator (the upper date indicator) 20 alone is sequentially fed by the second driving finger 37 such that the denotations of the dates are fed from the date $1^{st}$ to the date $15^{th}$ Switching the dates from the date $15^{th}$ to the date $16^{th}$ will be described later.

As shown in FIGS. 4 and 5, with the first date indicator (the lower date indicator) 10 in the normal driving state, the date indicator driving wheel 30 receives a driving force from the hour wheel 5 rotating in the direction C, and thus rotates in the direction B. The date dial driving finger (the driving finger) 33, mounted on the date indicator driving wheel 30 and having the long hole 33*c*, rotates in the direction B. With the first date indicator (the lower date indicator) 10 in a normal driving state, the second driving finger 37 escapes as the abutment portion 34 abuts on the tooth portion 10*a* of the first date indicator (the lower date indicator) 10, and the first driving finger 35 sequentially feeds the toothed portion 10*a* of the first date indicator (the lower date indicator) 10 from the date $16^{th}$ to the date $31^{st}$. Switching the dates from the date $31^{st}$ to the date $1^{st}$ will be described later.

(4) In the following, with reference to FIGS. 6 to 11, operations of the first date indicator 10, the second date indicator 20, and the date indicator drive control portion (the date indicator driving mechanism in this example) 30M will be described in detail.

Figure 6:
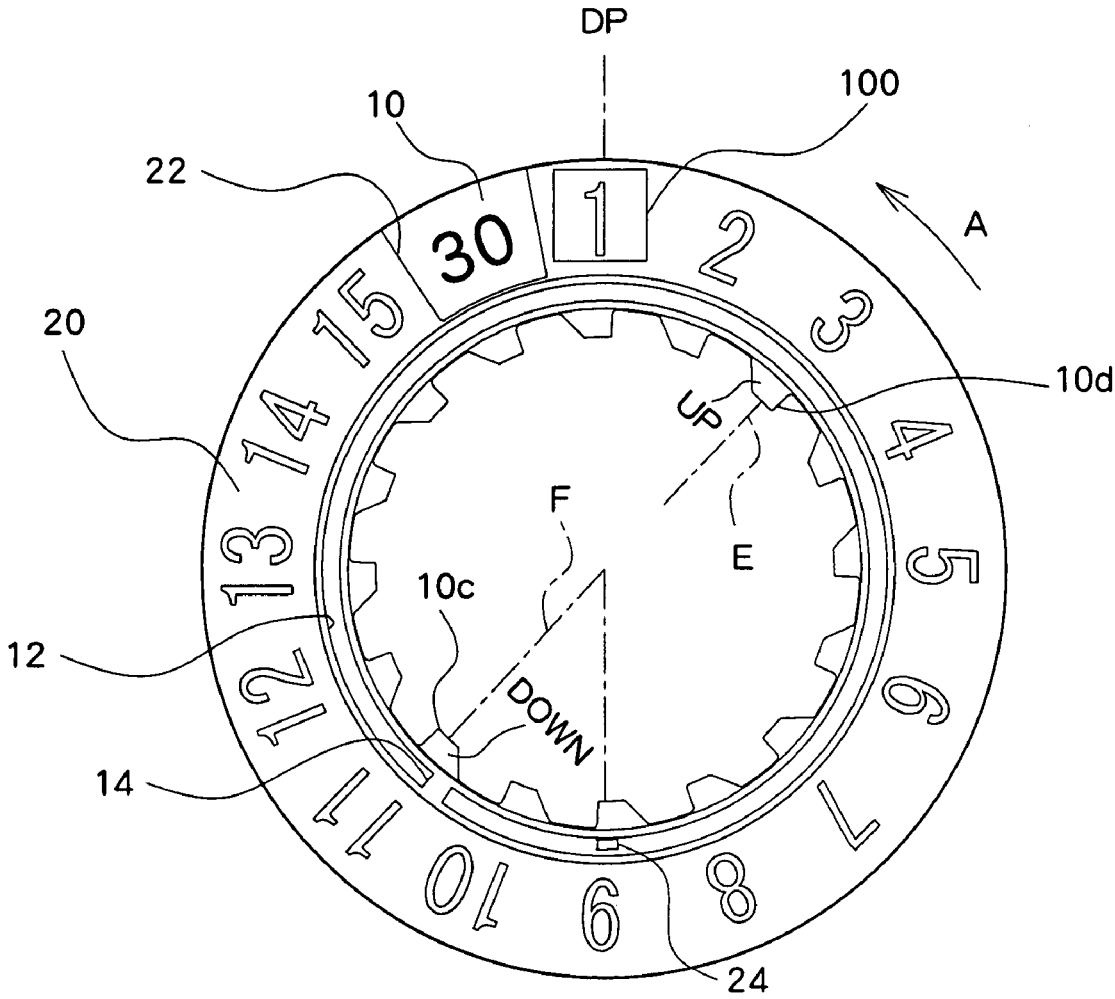
FIG. 6 is a plan view explaining a date indicator of the timepiece calendar device shown in FIG. 1 in a normal driving state, showing the date $1^{st}$ on display and schematically showing the state of concurrent drive means.
Figure 7:
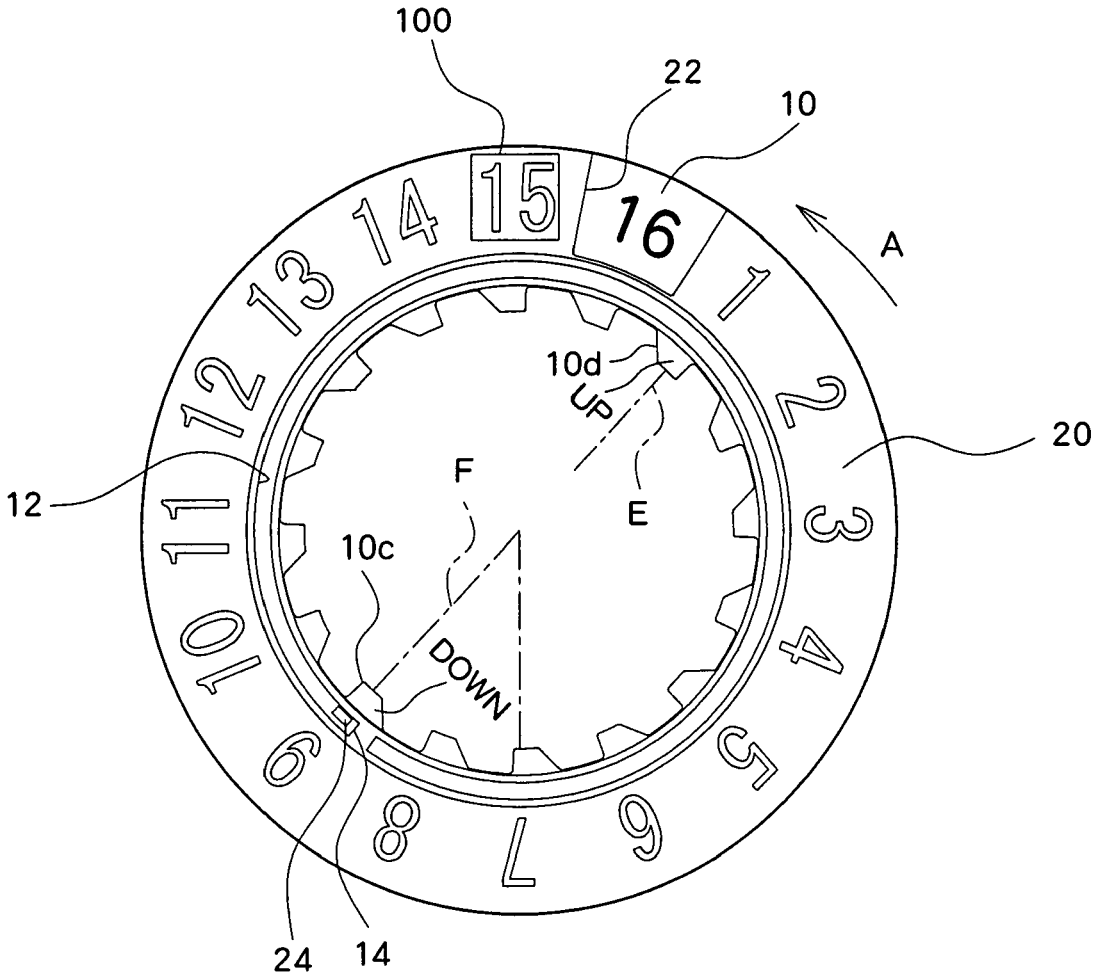
FIG. 7 is a plan view explaining the date indicator of the timepiece calendar device shown in FIG. 1 in a normal driving state, showing the date $15^{th}$ on display and also schematically showing the state of the concurrent drive means.
Figure 8:
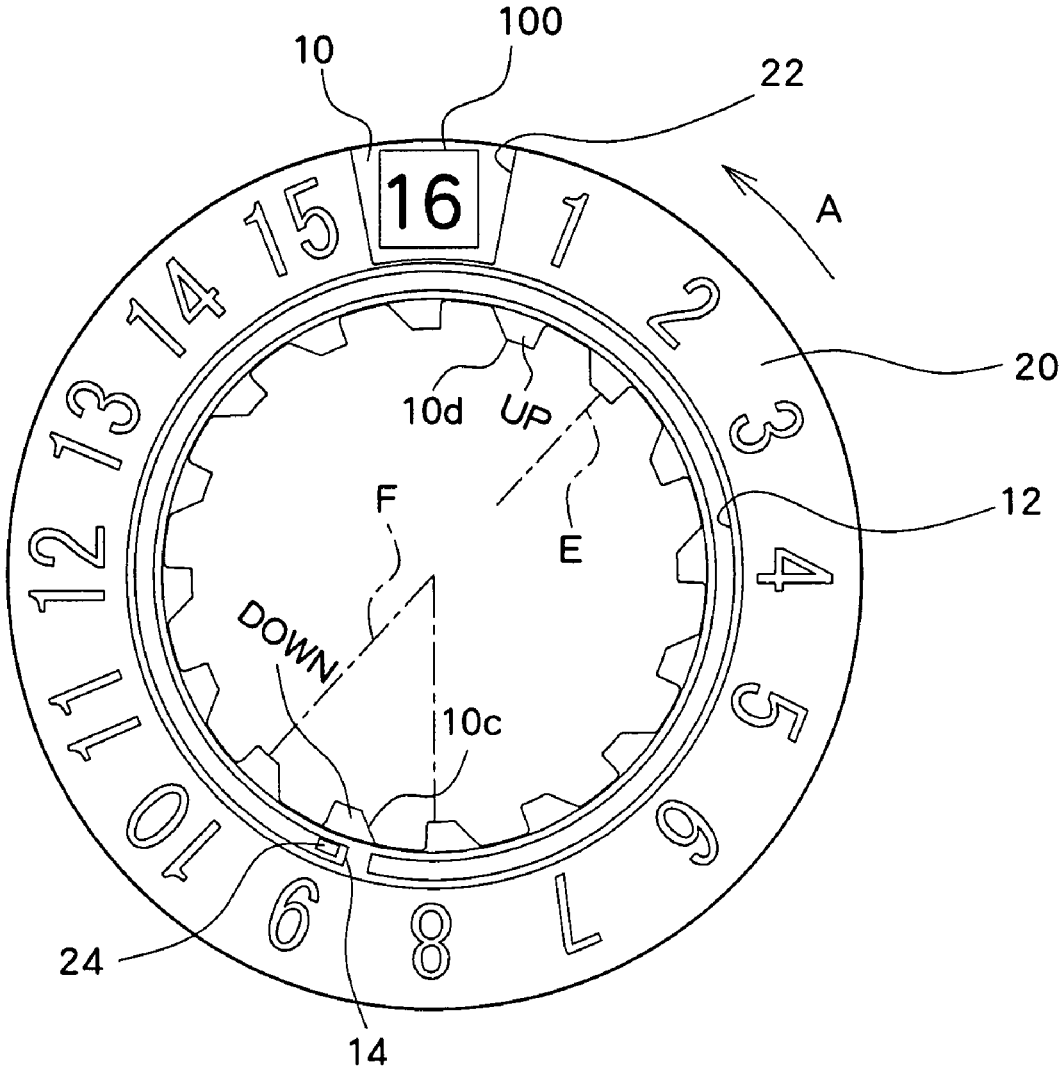
FIG. 8 is a plan view explaining the date indicator of the timepiece calendar device shown in FIG. 1 in a normal driving state, showing the date $16^{th}$ on display and also schematically showing the state of the concurrent drive means.
Figure 9:
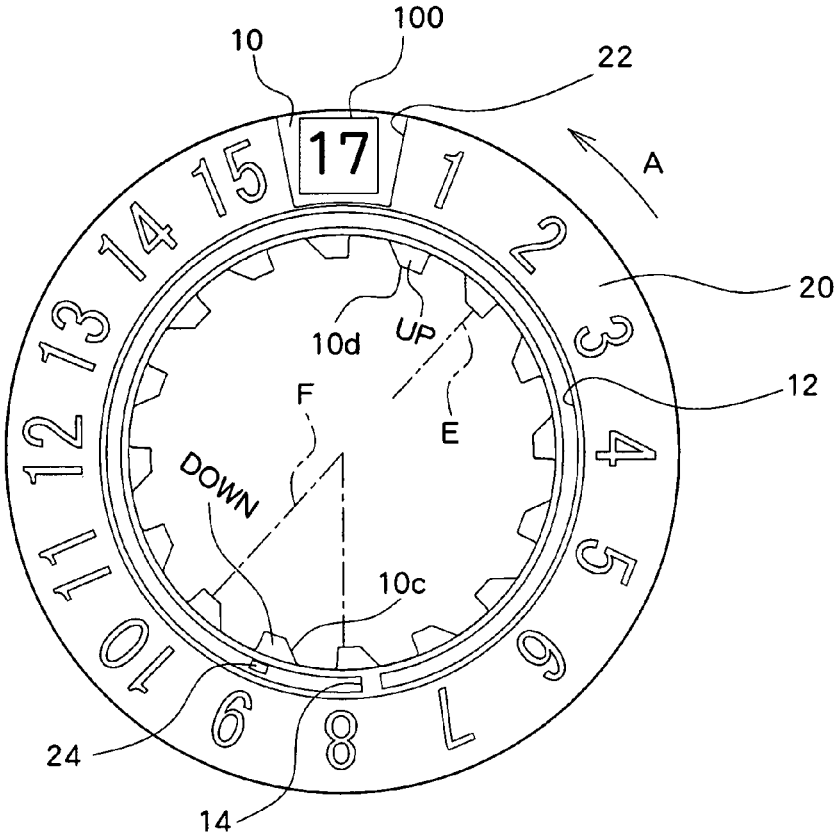
FIG. 9 is a plan view explaining the date indicator of the timepiece calendar device shown in FIG. 1 in a normal driving state, showing the date $17^{th}$ on display and also schematically showing the state of the concurrent drive means.
Figure 10:
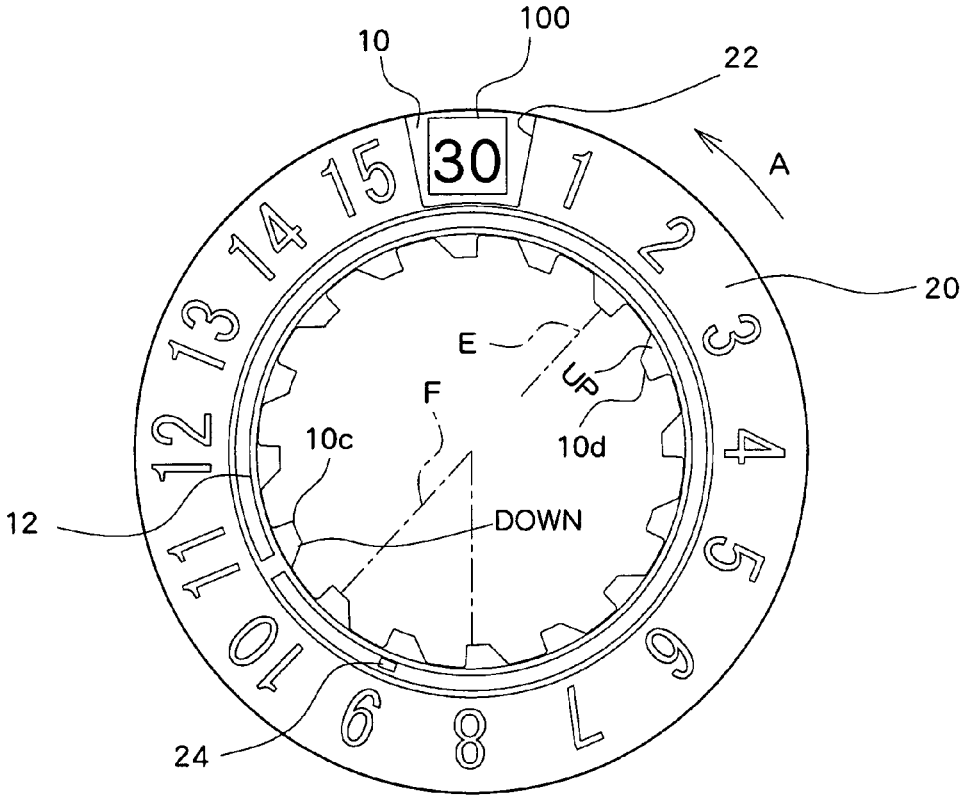
FIG. 10 is a plan view explaining the date indicator of the timepiece calendar device shown in FIG. 1 in a normal driving state, showing the date $30^{th}$ on display and also schematically showing the state of the concurrent drive means.
Figure 11:
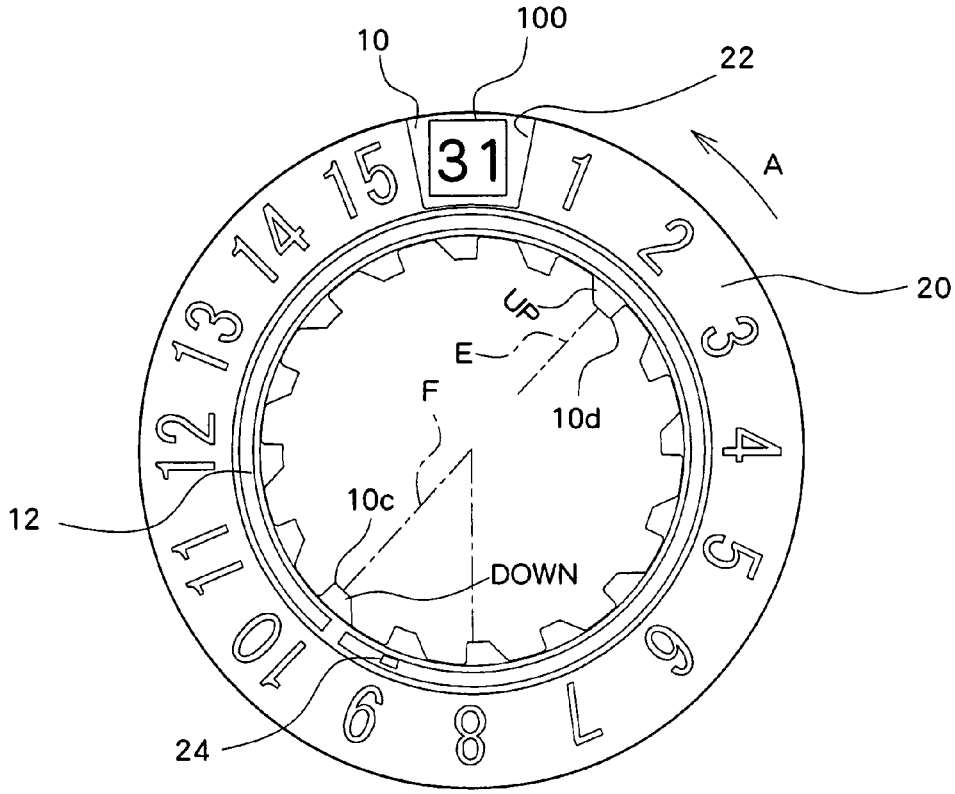
FIG. 11 is a plan view explaining the date indicator of the timepiece calendar device shown in FIG. 1 in a normal driving state, showing the date $31^{st}$ on display and also schematically showing the state of the concurrent drive means.

In FIGS. 6 to 11, the dial is removed except for the window 100. The drawings are plan views explaining the date indicator in a normal driving state. FIG. 6 shows the date $1^{st}$ on display. FIG. 7 shows the date $5^{th}$ on display; FIG. 8 shows the date $16^{th}$ on display; and FIG. 9 shows the date $17^{th}$ on display. FIG. 10 shows the date $30^{th}$ on display; and FIG. 11 shows the date $31^{st}$ on display. The display window 100 defined on the dial is located in the position DP of 12 o'clock in the upper portion in the drawing, similar to the embodiment shown in FIG. 1. In the respective drawings, the positions of the arc groove 12 defined on the first date indicator (the lower date indicator) 10 and the groove wall 14 formed where the groove is disconnected are shown. In addition, the projection 24, mounted on the second date indicator (the upper date indicator) and to be engaged with the arc groove 12, is also shown in the respective drawings.

The positions where the toothed portions 10*a*, 20*a* of the date indicators 10, 20 are engaged with the date dial driving finger 33 are indicated by the line F. The positions where the toothed portions 10*a*, 20*a* of the date indicators 10, 20 are engaged with the correction finger 53 of the corrector setting wheel 50 are indicated by the line E. The positions of the first toothless portion 10*c* and the second toothless portion 10*d*, formed in the toothed portion 10*a* of the first date indicator, are shown in the respective drawings. In FIGS. 6 to 11, for ease of understanding, the label "DOWN" is attached to the upper surface of the toothed portion 10*a* having the first toothless portion 10*c*, indicating that a tooth is partially removed on the upper surface side and present on the lower surface side; the label "UP" is attached to the upper surface of the toothed portion 10*a* having the second toothless portion 10*d*, indicating that a tooth is partially removed on the lower surface side and present on the upper surface side. The first toothless portion 10*c* relates to control of drive switching from the first driving finger 35 to the second driving finger 37 when normally driving the date dial; the second toothless portion 10*d* relates to control of drive switching from the third driving finger 55 to the fourth driving finger 57 when correcting the dates. The arrow A indicates the rotation direction of the date indicator.

In FIG. 6, showing the date $1^{st}$ on display, the denotation of the date $1^{st}$ on the second date indicator 20 appears in the display window 100. In this case, the denotation of the date $31^{st}$ on the first date indicator 10 is located below the denotation of the date $1^{st}$ on the second date indicator in the display window 100. In the above, the first toothless portion 10*c* of the first date indicator 10 is located on the line F, which corresponds to the date dial driving finger 33. Therefore, in feeding to the next date, namely, the date $2^{nd}$, the first date indicator 10 is not fed by the first driving finger 35 with a resulting air-swing, and only the toothed portion 20*a* of the second date indicator 20 is driven by the second driving finger 37, as described with reference to FIG. 2, so that the denotation of the date $2^{nd}$ appears in the display window 100. This operation in which the first date indicator 10 remains still and only the second date indicator 20 is driven for every day is continued until the date $15^{th}$ shown in FIG. 7.

In FIG. 7, showing the date $15^{th}$ on display, the denotation of the date $15^{th}$ appears in the display window 100, with the denotation of the date $31^{st}$ on the first date indicator 10 located therebelow, not moving from the state shown in FIG. 6. The denotation of the date $16^{th}$, or the next day, is located below the opening 22 on the second date indicator 20. The groove wall 14 of the arc groove 12 is followed immediately by the projection 24. In feeding from the date $15^{th}$ to the date $16^{th}$, although the second driving finger 37 drives only the toothed portion 20*a* of the second date indicator 20, as the projection 24 of the second date indicator 20 presses the groove wall 14 of the arc groove 12 of the first date indicator 10, the second date indicator 20 moves following the first date indicator 10. Consequently, the state shown in FIG. 8 results.

In the first embodiment, the first date indicator 10 and the second date indicator 20 are concurrently driven once.

In FIG. 8, showing the date $16^{th}$ on display, the opening 22 on the second date indicator 20 is located below the display window 100, so that the denotation of the date $16^{th}$ on the first date indicator 10 is exposed in the display window 100 through the opening 22. As the first toothless portion 10*c* of the first date indicator 10 is located displaced by one day in the direction A relative to the position of the line F, which corresponds to the date dial driving finger 33, as described with reference to FIG. 4, the abutment portion 34 of the date dial driving finger 33 abuts on the normal toothed portion 10*a* of the first date indicator 10; the second driving finger 37 is separated from the toothed portion 20*a* of the second date indicator 20; and the toothed portion 10*a* of the first date indicator 10 is driven by the first driving finger 35. Therefore, in feeding to the next date, namely, the date $17^{th}$, the first driving finger 35 drives only the toothed portion 10*a* of the first date indicator 10, and the second date indicator 20 is not fed, with the opening 22 remaining in the current position.

FIG. 9 shows the date $17^{th}$ on display. The operation in feeding the date from $16^{th}$ to $17^{th}$, in which the second date indicator 20 remains still and only the first date indicator 10 is driven for every day, is continued until the date $31^{st}$, shown in FIG. 11.

FIG. 10 shows the date $30^{th}$ on display. The opening 22 of the second date indicator 20 is located below the window 100, so that the denotation of the date $30^{th}$ on the first date indicator 10 is exposed in the window 100 through the opening 22.

In this state, the first toothless portion 10*c* of the toothed portion 10*a* of the first date indicator 10 is located short of the line F by one tooth. Therefore, the second date indicator 20 remains still and only the first date indicator 10 is driven by one day. Consequently, the date on display shifts from the date $30^{th}$, shown in FIG. 10, to the date $31^{st}$, shown in FIG. 11.

FIG. 11 shows the date $31^{st}$ on display. The opening 22 of the second date indicator 20 is located below the window 100, so that the date $31^{st}$ on the first date indicator 10 is exposed in the window 100 through the opening 22. However, since the first toothless portion 10*c* of the toothed portion 10*a* of the first date indicator 10 is located on the line F, only the second driving finger 37 drives the toothed portion 20*a* of the second date indicator 20 in feeding to the next day, namely, the date $1^{st}$, by the date dial driving finger 33, as the first driving finger 35 and the abutment portion 34, mounted on the date dial driving finger 33, are fitted into the first toothless portion 10*c*, as shown in FIG. 2. Consequently, the denotation of the date $1^{st}$ appears in the window 100; an air-swing results with respect to the first date indicator 10; and the denotation of the date $1^{st}$ is located below the display window 100. This state corresponds to the state in which the date $1^{st}$ is on display, as shown in FIG. 6. As described above, circulation display is carried out every month.

It should be noted that in a short month, the fact that the date $31^{st}$ is not needed is compensated for by advancing the timepiece hand or using the date correction mechanism.

For backward rotation (reverse rotation) for correction, the first driving finger 35 and the second driving finger 37 of the date dial driving finger 33 have slope surfaces in the direction opposite from the feeding direction (shown in FIGS. 1, 2, and 4), and the slope surface makes it possible for the date dial driving finger 33 to escape, preventing the first date indicator 10 and the second date indicator 20 from rotating backward.

Figure 13:
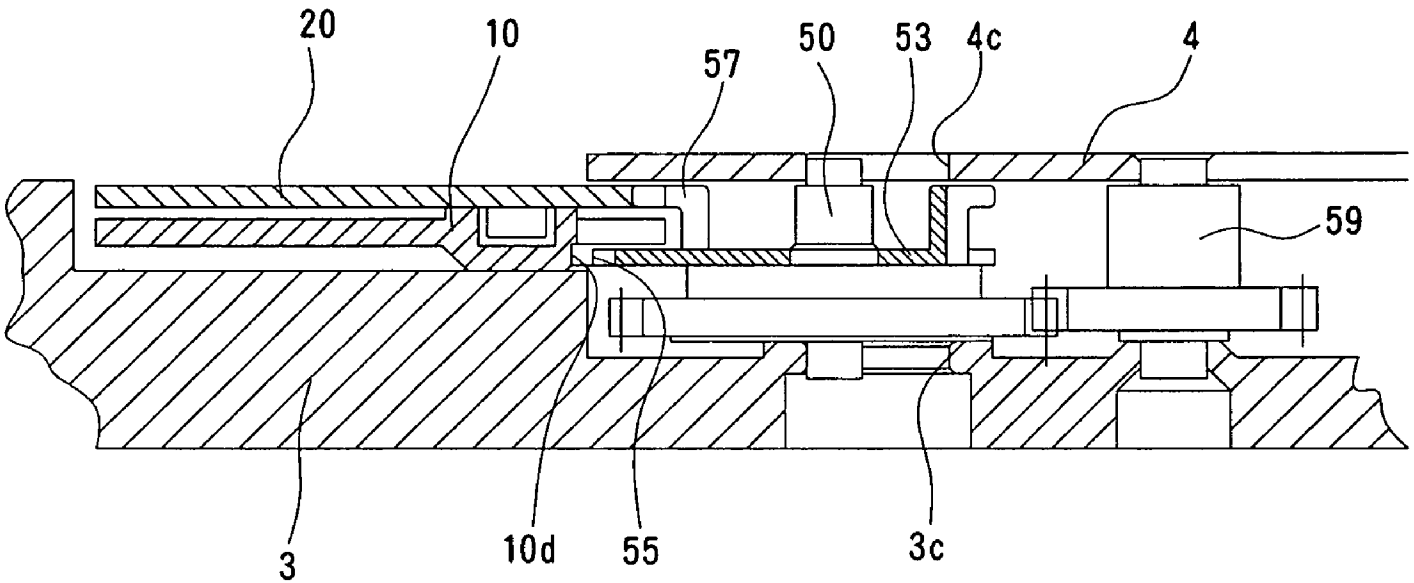
FIG. 13 is a cross sectional view along the line Y13-Y13 in FIG. 12.
Figure 14:
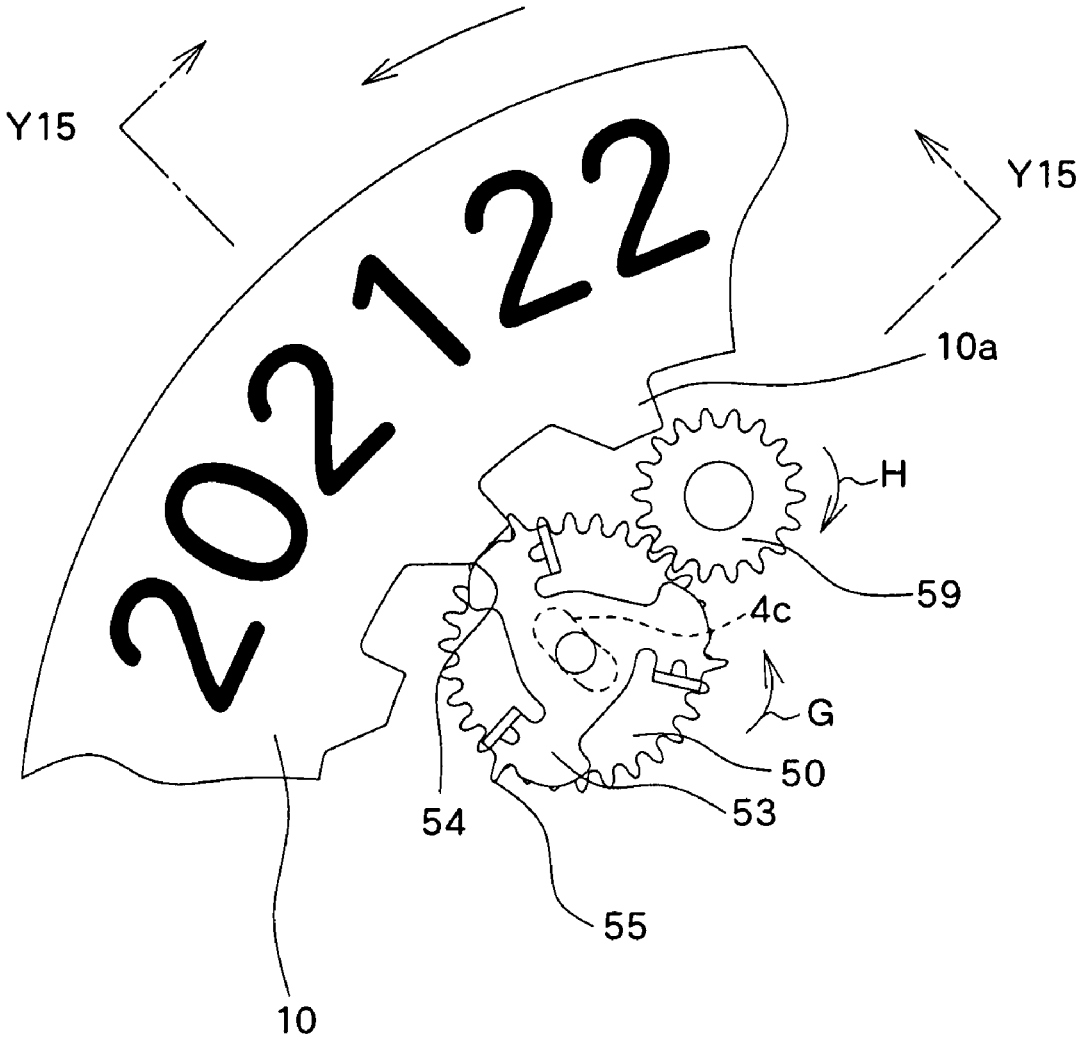
FIG. 14 is a partial plan view of a timepiece calendar device shown in FIG. 1, showing the first date indicator (the lower date indicator) in a correction state.
Figure 15:
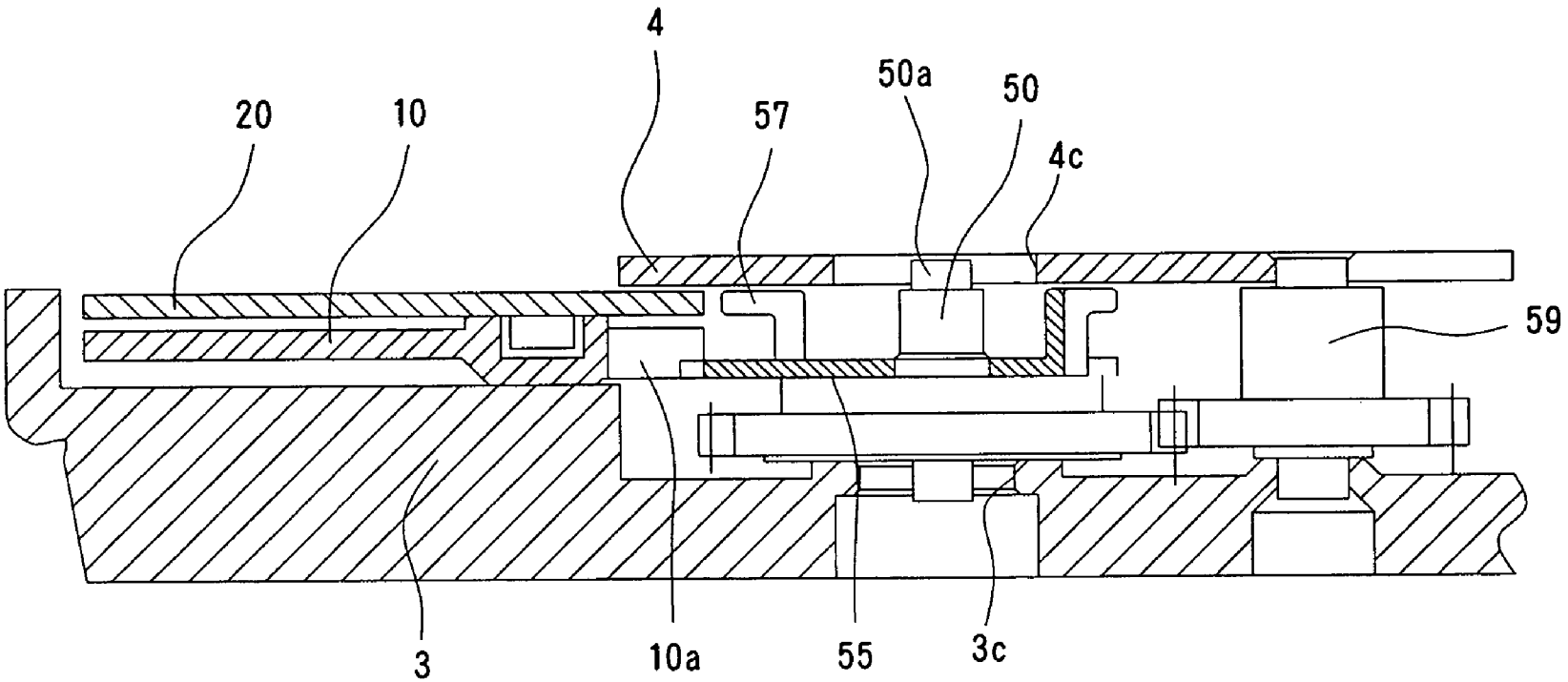
FIG. 15 is a cross sectional view along the line Y15-Y15 in FIG. 14.

(5) In the following, with reference to FIGS. 1 and 12 to 15, the structure of the date correction mechanism 50M in this embodiment will be described. FIG. 12 is a partial plan view of the timepiece calendar device in FIG. 1, showing the second date indicator (the upper date indicator) 20 in a correction state. FIG. 13 is a cross sectional view along the line Y13-Y13 in FIG. 12. FIG. 14 is a partial plan view of the timepiece calendar device in FIG. 1, showing the first date indicator (the lower date indicator 10) in a correction state. FIG. 15 is a cross sectional view along the line Y15-Y15 in FIG. 14.

The date correction mechanism 50M comprises a corrector setting wheel 50, a date corrector setting transmission wheel III 63, a date corrector setting transmission wheel II 61, and a date corrector setting transmission wheel I 59 for transmitting a correction rotational force from the crown 6 via the hand setting stems 6*a*. The corrector setting wheel 50 fixedly holds the date corrector finger 53. The date corrector finger 53 comprises a third driving finger 55 for correctively driving the toothed portion 10*a* of the first date indicator 10 and a fourth driving finger 57 for correctively driving the toothed portion 20*a* of the second date indicator 20, and is formed so as to integrally drive for rotation around a predetermined rotational center as a reference axis.

The engagement portion 55*a* of the third driving finger 55 is positioned closer to the toothed portions 10*a*, 20*a* of the date indicators 10, 20 than the engagement portion 57*a* of the fourth driving finger 57. That is, the length from the predetermined rotational center (the shaft center of the corrector setting wheel 50) to the engagement portion 55*a* of the third driving finger 55 is determined longer than the length from the predetermined rotational center (the shaft center of the corrector setting wheel 50) 50*a* to the engagement portion 57*a* of the fourth driving finger 57. The shaft of the corrector setting wheel 50 is inserted, on the upper and lower ends thereof, into the arc-shaped long hole 3*c* defined on the main plate 3 and the identically shaped, in plan view, long hole 4*c* defined on the holder plate 4, so that the shaft of the corrector setting wheel 50 slides in the long holes 3*c*, 4*c*.

The toothed portion 10*a* of the first date indicator 10, which is located on the drive path of the third driving finger 55 corresponding to a period of time in which the fourth driving finger 57 drives, for correction, the toothed portion 20*a* of the second date indicator 20, is provided with a second toothless portion 10*d* for avoiding engagement with the third driving finger 55. With the abutment portion 54 of the driving finger (the date corrector finger here) 53 inserted into the second toothless portion 10*d*, the fourth driving finger 57 is introduced to the drive path for engagement with the toothed portion 20*a* of the second date indicator 20. The third driving finger 55 and the fourth driving finger 57 constitute a reverser mechanism for making it possible for a predetermined shaft (the shaft 59*a* of the date corrector setting transmission wheel I 59 in this embodiment) to change the rotational center position thereof, that is, a reverser mechanism in which the shaft of the corrector setting wheel 50 slides in the arc-shaped long holes 3*c*, 4*c* in this example.

As described above, the first date indicator 10 comprises a first toothless portion 10*c* for avoiding engagement with the first driving finger 35 and a second toothless portion 10*d* for avoiding engagement with the third driving finger 55. The first toothless portion 10*c* has tooth partially removed on the upper surface side of the toothed portion 10*a* of the first date indicator 10 and present on the lower surface side thereof; the second toothless portion 10*d* has teeth removed on the lower surface side of the toothed portion 10*a* of the first date indicator 10 and present on the upper surface side thereof.

(6) In the following, an operation of the date correction mechanism 50M will be described.

Figure 12:
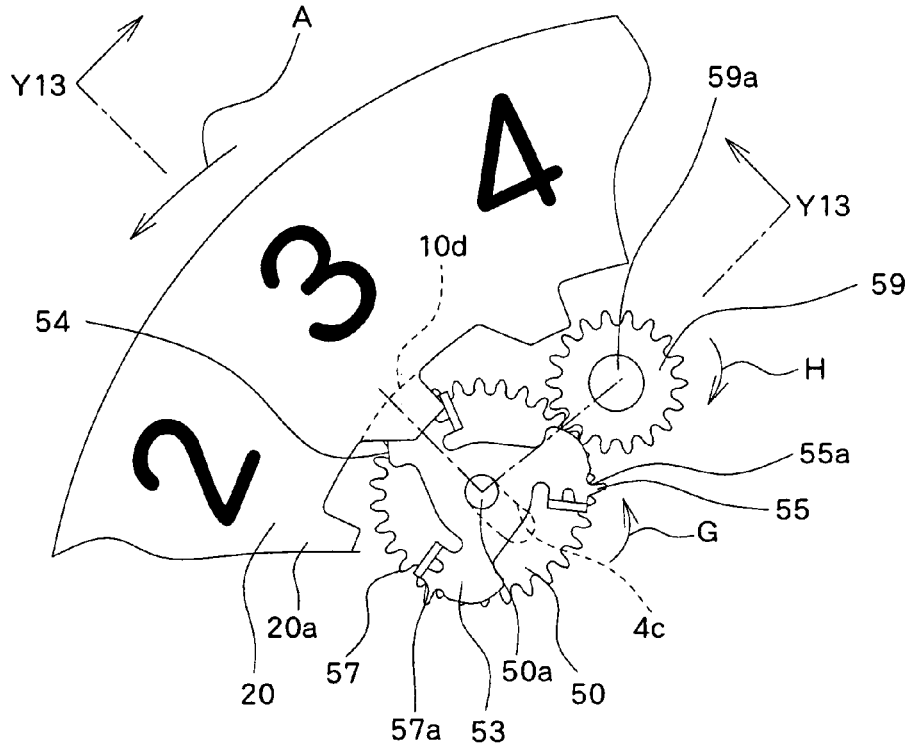
FIG. 12 is a partial plan view of a timepiece calendar device shown in FIG. 1, showing a second date indicator (an upper date indicator) in a correction state.

With the date corrector setting transmission wheel II 61, the date corrector setting transmission wheel I 59, and the corrector setting wheel 50 rotating in the directions indicated by the arrows G, H, I, respectively, shown in FIGS. 1, 12 and 14, via the crown 6, the hand setting stem 6*a*, and the date corrector setting transmission wheel III 63, the shaft of the corrector setting wheel 50 is pressed, and thus moves in the long holes 4*c*, 3*c*, shown in FIG. 12 (3*c* shown in FIG. 13) towards the external side of the date indicator due to the reverser mechanism. In FIGS. 12 and 13, the second toothless portion 10*d* of the first date indicator 10 is located opposed to the third driving finger 55. Therefore, from the date $1^{st}$ to the date $15^{th}$, the fourth driving finger 57 sequentially feeds the second date indicator 20 alone in the direction A in FIG. 12. With the date $15^{th}$ shown, the projection 24 on the rear surface of the second date indicator 20 presses the groove wall 14 of the arc groove 12 of the first date indicator 10, so that the date indicators 10, 20 are both fed in association. With the above, as shown in FIGS. 14 and 15, with feeding from the date $15^{th}$ to the date $16^{th}$, the second toothless portion 10*d* moves, and the normal toothed portion 10*a* of the first date indicator 10 comes to be located where the second toothless portion 10*d* is located thus far. Consequently, the abutment portion 54 comes into contact with the toothed portion 10*a* of the first date indicator 10; the fourth driving finger 57 escapes; and the third driving finger 55 sequentially feeds the toothed portion 10*a* of the first date indicator (the lower date indicator) 10 from the date $16^{th}$ to the date $31^{st}$. On the date $31^{st}$, the second toothless portion 10*d* has returned to be located again opposed to the third driving finger 55. In feeding to the next date, or the date $1^{st}$, only the second date indicator 20 is fed, while the first date indicator (the lower date indicator) 10 remains still. The above-described feeding is repeated until the date $15^{th}$. As described above, the date correction circulates. In this embodiment, the structure of the date correction mechanism 50M which is free from interference with the date indicator drive control portion (the date indicator driving mechanism in this example) 30M is attained.

Second Embodiment

In the following, a second embodiment will be described. FIG. 16 to FIG. 28 relate to the second embodiment. The second embodiment is the same as the first embodiment in that the first date indicator and the second date indicator have the same number of date display frames (including the opening), and that the corresponding number of toothed portions of the first date indicator and that of the second date indicator are the same. However, the number of date display frames (including the opening) of the respective date indicators is seventeen, different from sixteen in the first embodiment. In addition, in the second embodiment, a toothless portion is also provided at the toothed portion of the second date indicator. Therefore, accordingly, the date indicator drive control portion (the date indicator driving mechanism in this example) (in particular, the date indicator drive control portion) and the date correction mechanism (in particular, the driving finger) are different and simplified from those in the first embodiment.

Basically, any structural elements in the second embodiment, which correspond to those in the first embodiment are assigned a reference number with "200", and "2" added to an alphabetical reference note.

Figure 16:
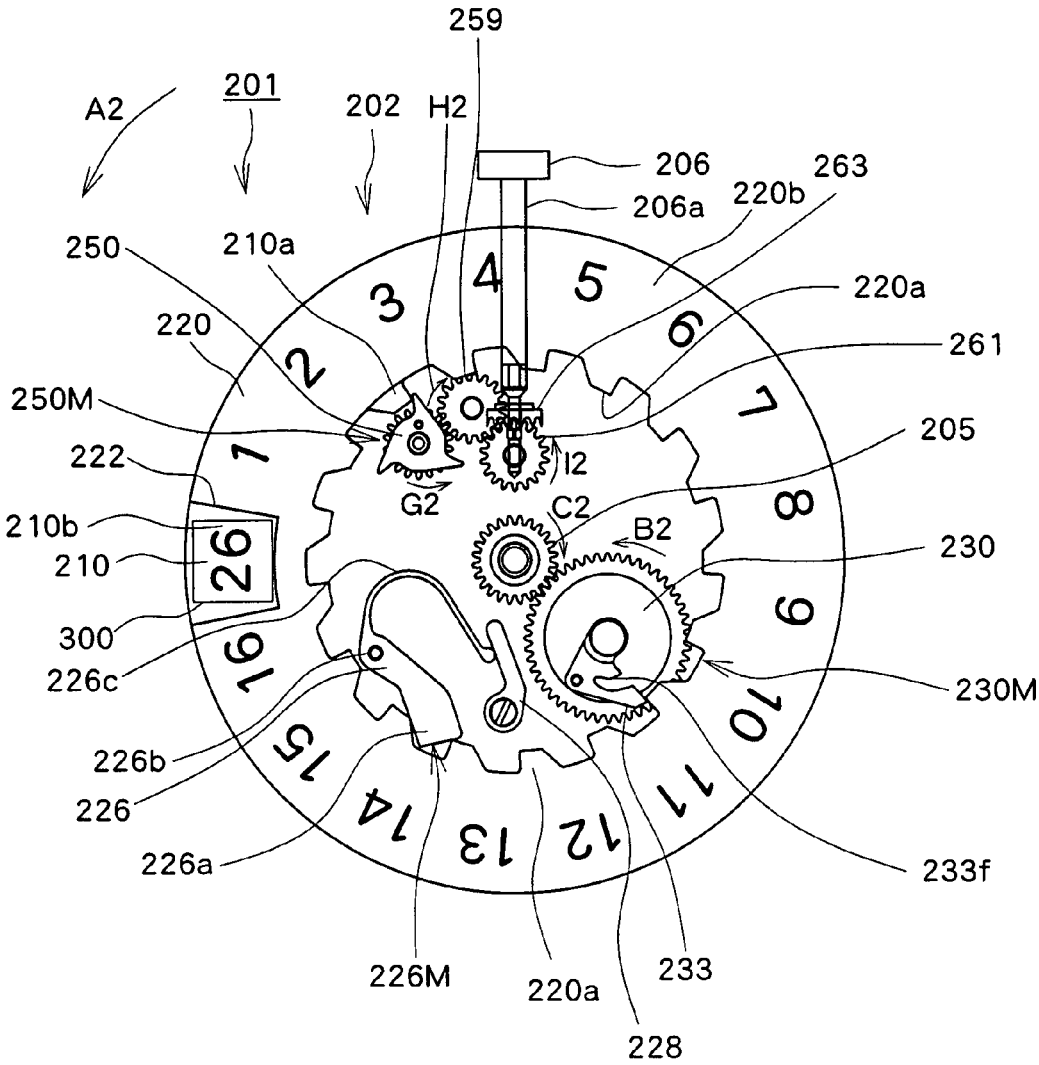
FIG. 16 is a plan view of a complete timepiece calendar device in a second embodiment of the present invention, with the dial removed, showing the second date indicator (the upper date indicator) in a normal display state and the corrector setting wheel in an operation start state, with a calendar window defined on the dial located at the position of 12 o'clock (that is, the letter "26" described on the first date indicator (the lower date indicator) in FIG. 16) in this example.

(1) FIG. 16 is a plan view of a complete timepiece calendar device in the second embodiment of the present invention, in which the dial and the holder plate are removed.

The calendar device 202 of the timepiece 201 in this embodiment comprises a first date indicator 210 as a first display wheel (a lower date indicator here, the same applies in the following), a second date indicator 220 as a second display wheel (an upper date indicator here, same in the following), a date jumper mechanism 226M, a date indicator drive control portion (a date indicator driving mechanism in this example) 230M, and a date correction mechanism 250M, in which the first date indicator 210 and the second date indicator 220 are placed one on top of the other.

Figure 17:
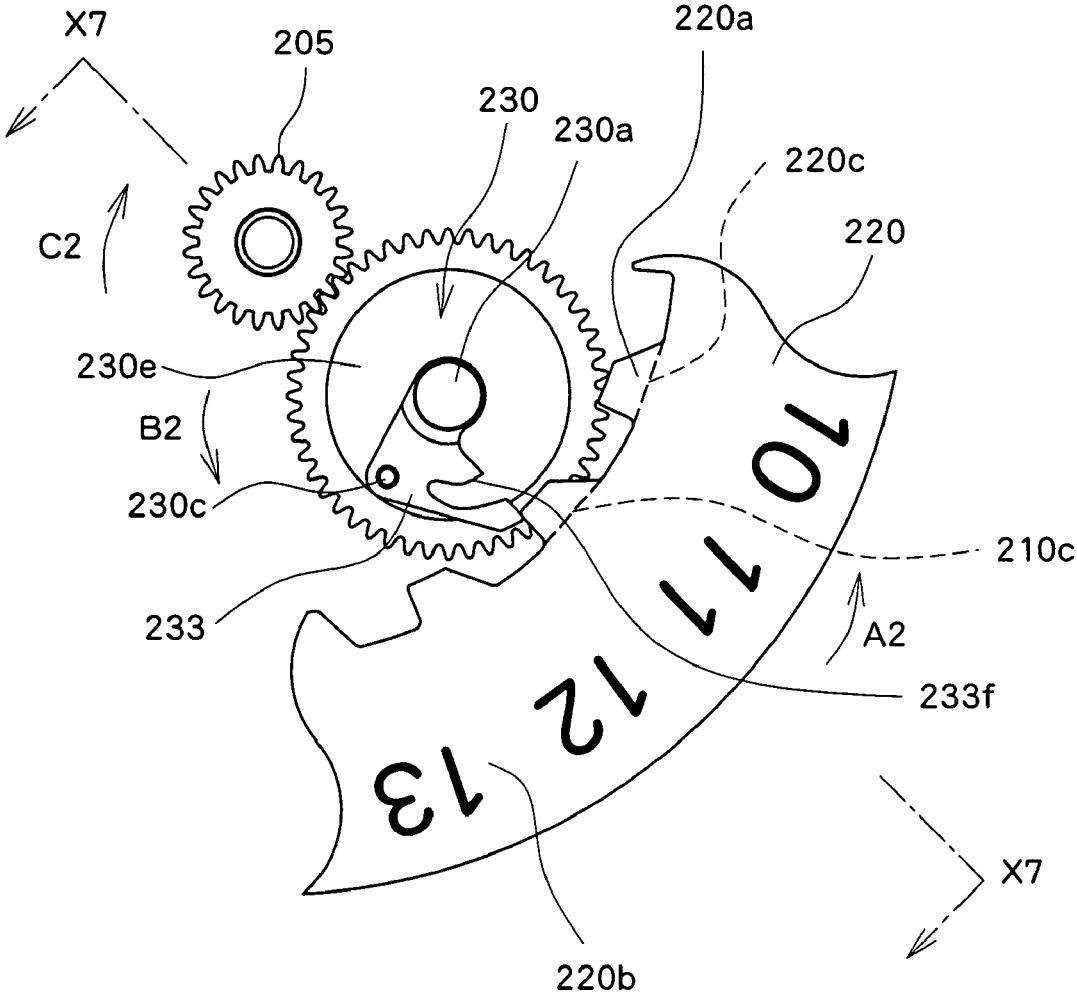
FIG. 17 is a partial plan view of a timepiece calendar device shown in FIG. 16, showing the second date indicator (a second engagement state) in a normal driving state.
Figure 18:
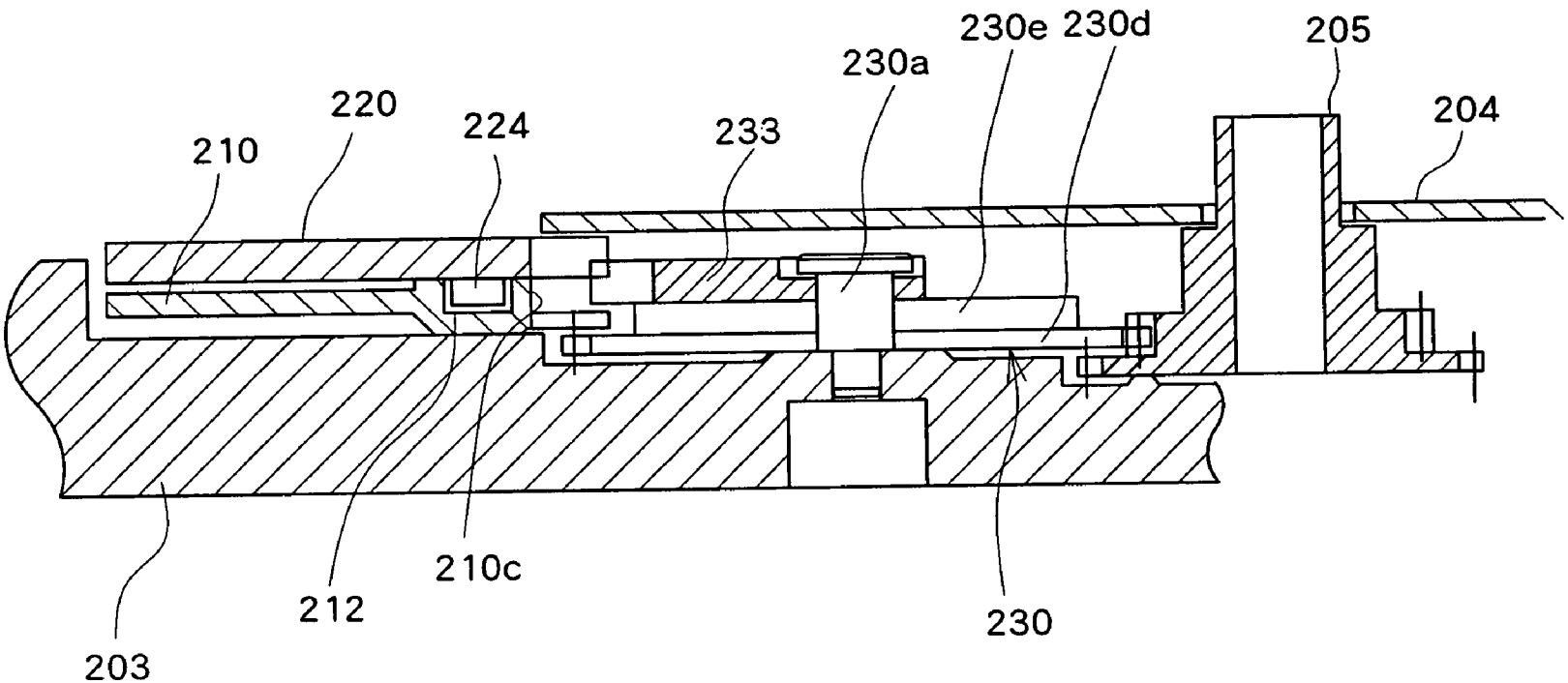
FIG. 18 is a cross sectional view along the line X7-X7 in FIG. 17.
Figure 19:
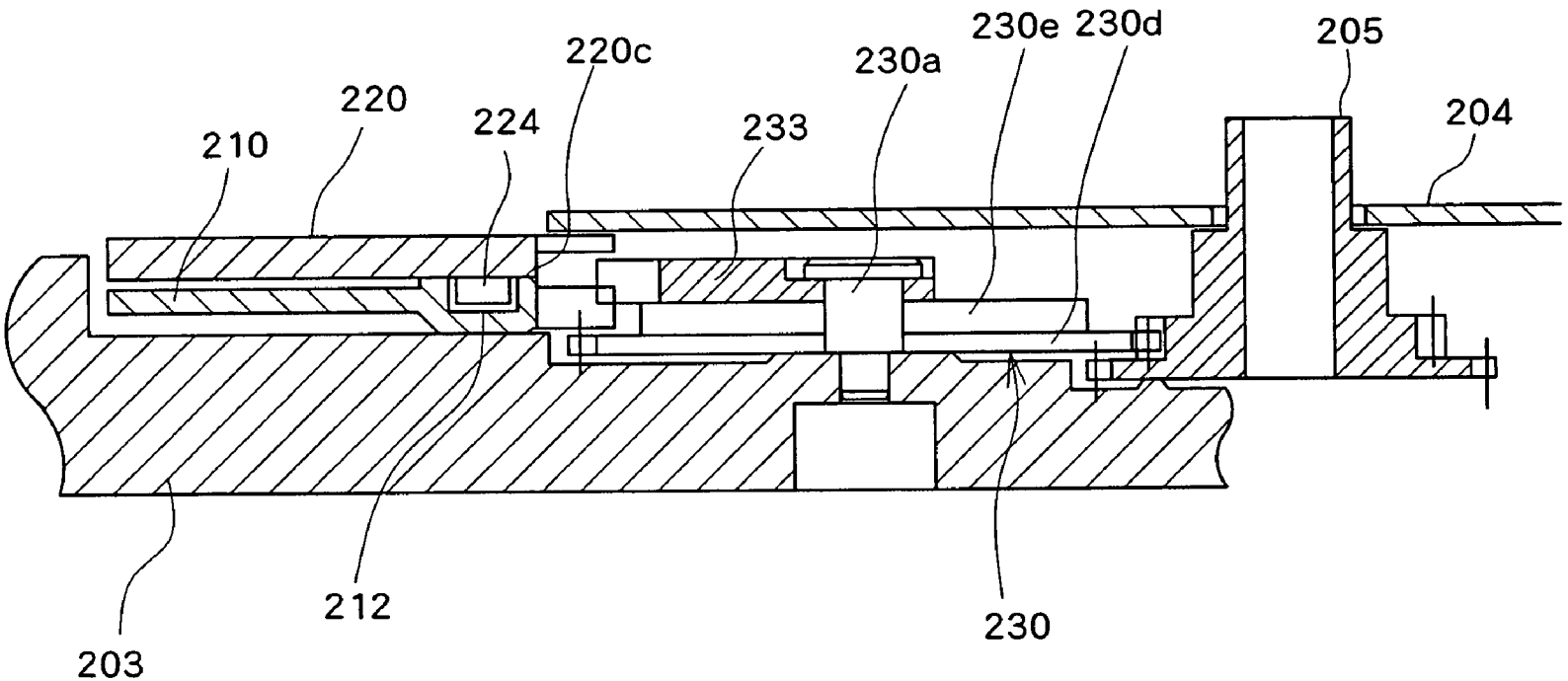
FIG. 19 is a partial plan view, similar to FIG. 18, of a timepiece calendar device shown in FIG. 16, showing the first date indicator (a first engagement state) in a normal driving state.

(2) With reference to FIGS. 16 to 19, structures of the date indicators 210, 220, the date jumper mechanism 226M, and the date indicator drive control portion (the date indicator driving mechanism in this example) 230M in this embodiment will be described. FIG. 16 is a plan view of a complete timepiece calendar device 202, showing the first date indicator 210 in a normal driving state, the upper date jumper 226 holding the second date indicator 220 in a stable position, the lower date jumper 226 holding the first date indicator 210 in a stable position, and the corrector setting wheel 250 in a not-operating state. The display window (a window on the dial, referred to as a calendar window) 300 defined on the dial is located at the position of twelve o'clock in this example (that is, where the number "26" on the first date indicator 210 is shown in FIG. 16). FIG. 17 is a partial plan view of the timepiece calendar device 202 shown in FIG. 16, showing the second date indicator 220 in a normal driving state (a second engagement state) FIG. 18 is a cross sectional view along the line X7-X7 in FIG. 17. FIG. 19 is a partial cross sectional view, similar to FIG. 18, of the timepiece calendar device 202 shown in FIG. 16, showing the first date indicator 210 in a normal driving state (a first engagement state). In the cross sectional views of FIGS. 18 and 19 (also, FIGS. 26 and 27), a holder plate 204 for pressing the date indicator or the like is shown.

(a) First Date Indicator 210, Second Date Indicator 220

The first date indicator 210 and the second date indicator 220 are placed one on top of the other. The annular first date indicator 210 has a denotation portion 210*b* showing a partial period of a calendar on the front surface thereof and a toothed portion 210*a* to be driven. The annular second date indicator (the upper date indicator) 220 has a denotation portion 220*b* showing a partial period of the calendar other than that which is shown on the first date indicator 210 on the front surface thereof, an opening 222 via which expose the first date indicator 210 is exposed, and a toothed portion 220*a* to be driven. The toothed portions 210*a*, 220*a* of the first date indicator 210 and the second date indicator 220 are formed so as to rotate along the identical paths in a plan view (the paths are shown completely overlapped in a plan view in this embodiment).

In the date indicators in this embodiment, the first date indicator (the lower date indicator) 210 has, on the upper surface side thereof, a date denotation portion including denotations of the dates $17^{th}$ to $31^{st}$ and two blank spaces, or information-free portions (calendar-free portions) SP1, SP2, and a partially disconnected groove, or an arc groove 212 here (schematically shown in a plan view in FIGS. 20 to 24), and the second date indicator (the upper date indicator) 220 has denotations of the dates $1^{st}$ to $16^{th}$, an opening 222, and a projection 224 to be inserted into the arc groove 212 of the first date indicator 210. In this example, engagement state switching means is constituted containing concurrent drive means of the date indicators having the arc groove 212 and the projection 224, respectively.

The toothed portion 210*a* of the first date indicator (the lower date indicator) 210 has a first toothless portion 210*c* for enabling the driving finger 233 of the date indicator driving wheel 230, to be described later, to air-swing with respect to the toothed portion 210*a* when the denotation of the information-free portion (the calendar-free portion) SP1 is located below the display window 300 of the dial (shown in FIGS. 17 and 18). In shifting the denotations on the date indicators from the date $1^{st}$ to the date $2^{nd}$, for example, the first date indicator (the lower date indicator) 210 is not fed due to the presence of the first toothless portion 210*c*, and instead, the driving finger 233 is engaged with, and feeds, only the toothed portion 220*a* of the second date indicator (the upper date indicator) 220 such that the denotation of the date $2^{nd}$ is shown.

Also, the toothed portion 220*a* of the second date indicator (the upper date indicator) 220 has a third toothless portion 220*c* for enabling the driving finger 233 of the date indicator driving wheel 230, to be described later, to air-swing with respect to the toothed portion 220*a* when the opening 222 is located below the display window 300 of the dial (shown in FIG. 19). In shifting the denotations on the date indicators from the date $17^{th}$ to the date $18^{th}$, for example, the toothed portion 220*a* of the second date indicator (the upper date indicator) 220 is not fed due to the presence of the third toothless portion 220*c*, and instead, the driving finger 233 is engaged with, and feeds, only the toothed portion 210*a* of the first date indicator (the lower date indicator) 210 such that the denotation of the date $18^{th}$ is shown.

These operations will be described later in detail with reference to FIGS. 20 to 24. In this example, an air swing generation portion is formed, containing the first toothless portion 210*c* or the third toothless portion 220*c*.

Although the details will be described later, in relationship with the corrector setting wheel 250, similarly, the toothed portion 210*a* of the first date indicator (the lower date indicator) 210 has a second toothless portion 210*d* for enabling the third driving finger 255 of a corrector setting wheel 250, to be described later, to air-swing with respect to the toothed portion 210*a* when the information-free portion (the calendar-free portion) SP1 in the space portion is located below the display window (the window on the dial) 300 of the dial (shown in FIG. 26). In correcting the denotations on the date indicators from the date $13^{th}$ to the date $14^{th}$, for example, with the corrector setting wheel 250, the first date indicator (the lower date indicator) 210 is not fed due to the presence of the second toothless portion 210*d*, and instead, the fourth driving finger 257 feeds only the toothed portion 220*a* of the second date indicator (the upper date indicator) 220 such that the denotation of the date $14^{th}$ is shown.

Although the details will be described later, in relationship with the corrector setting wheel 250, similarly, the toothed portion 220*a* of the second date indicator (the upper date indicator) 220 has a fourth toothless portion 220*d* for enabling the fourth driving finger 257 of the corrector setting wheel 250, to be described later, to air-swing with respect to the toothed portion 220*a* when the opening 222 is located below the display window 300 defined on the dial (shown in FIG. 27).

In correcting the denotations on the date indicators with the corrector setting wheel 250 from the date $18^{th}$ to the date $19^{th}$, for example, the second date indicator (the upper date indicator) 220 is not fed due to the presence of the fourth toothless portion 220*d*, and instead, the third driving finger 255 feeds only the toothed portion 210*a* of the first date indicator (the lower date indicator) 210 such that the denotation of the date $19^{th}$ is shown.

In the second embodiment also, the first toothless portion 210*c* and the second toothless portion 210*d* of the first date indicator 210 and the third toothless portion 220*c* and the fourth toothless portion 220*d* of the second date indicator 220 have teeth formed thin in the width direction, rather than removed. Thus, teeth are present all along the toothed portions.

(b) Structure of Date Jumper Mechanism 226M

The date jumper mechanism 226M has two identically shaped date jumpers 226, 226, placed one on top of the other, for causing the two date indicators 210, 220 to jump. The date jumper mechanism 226M has date jumpers 226, 226 having mountain-like jumper portions 226*a*, 226*a* for contacting the toothed portion 210*a* of the first date indicator 210 and the toothed portion 220*a* of the second date indicator 220, respectively, and spring portions 226*c*, 226*c* extending on the other side relative to the rotational shaft 226*b*, and guard portion 228 fixed on the substrate (the main plate here) and for abutting on the ends of the spring portions 226*c*, 226*c*. As described above, the first date indicator 210 and the second date indicator 220 are caused to jump. As the two identically shaped date jumpers 226, 226 are placed one on top of the other, the date jumpers 226, 226, and thus the date jumper mechanism 226M, can be formed smaller in size in a plan view. As the first toothless portion 210*c* and the second toothless portion 210*d* of the first date indicator 210 and the third toothless portion 220*c* and the fourth toothless portion 220*d* of the second date indicator 220 in this embodiment have teeth formed thin in the width direction, rather than removed, the date jumpers 226, 226 are fitted into one space between the teeth of the first date indicator 210 and that of the second date indicator 220, respectively. This makes possible the use of a date jumper having a general shape, rather than a special shape.

(c) Structure of Date Indicator Drive Control Portion (Date Indicator Driving Mechanism in this Example) 230M The date indicator drive control portion (the date indicator driving mechanism in this example) 230M comprises a date indicator driving wheel 230, a driving finger (a date dial driving finger here) 233, fixedly mounted on the date indicator driving wheel 230 and for driving the first date indicator 210 and the second date indicator 220 to rotate, a toothed portion 210*a* of the first date indicator 210 and a toothed portion 220*a* of the second date indicator 220, both for contacting the driving finger 233, the groove (an arc groove in this example) 212 of the first date indicator 210, and the projection 224 of the second date indicator 220. The driving finger 233 has a notch 233*f* formed thereon in the rotational direction, which realizes an elastic structure of the driving finger 244 for enabling the tip end of the driving finger 233 to flex so that the driving finger 233 can escape when pressed by the toothed portions 210*a*, 220*a* of the date indicators from the direction (rear direction) opposite to the ahead direction A2 in the correction operation by the date correction mechanism 250M. The toothed portion 210*a* of the first date indicator 210 is provided with the above-described first toothless portion 210*c*, and the toothed portion 220*a* of the second date indicator 220 is provided with the above-described third toothless portion 220*c*, the toothless portions both constituting a part of the date indicator drive control portion (the date indicator driving mechanism in this example) 230M.

The toothed portions 210*a*, 220*a* of the first date indicator 210 and the second date indicator 220 are formed so as to rotate along substantially identical paths (the paths are shown completely overlapped in a plan view here). The driving finger 233 fixed on the date indicator driving wheel 230 rotates together with the date indicator driving wheel 230 to thereby feed the toothed portions 210*a*, 220*a*. As described above, with the second date indicator 220 placed on the first date indicator 210 and driving the respective date indicators every predetermined period of time, the denotation portion on one of the dials is exposed in the display window 300 on the dial, whereby the calendar is shown.

Therefore, the date indicator drive control portion 230M generates a first engagement state in which the driving finger 233 is engaged with the toothed portion 210*a* of the first date indicator 210 but not with the toothed portion 220*a* of the second date indicator 220 when the denotation portion 210*b* of the first date indicator 210 shows the information about a partial period through the opening 222 defined on the second date indicator 220 and in the window (the display window on the dial). The date indicator drive control portion 230M also comprises engagement state generation means for generating a second engagement state in which the driving finger 233 is engaged with the toothed portion 220*a* of the second date indicator 220 but not with the toothed portion 210*a* of the first date indicator 210 when the denotation portion 220*b* of the second date indicator 220 shows the information about the other period in the window 300, and engagement state switching means for switching the engagement states of the driving finger 233 relative to the toothed portions 210*a*, 220*a* of the first date indicator 210 and the second date indicator 220, respectively, to thereby mutually switch the first engagement state and the second engagement state.

The engagement state generation means is formed by an air swing generation portion, including the first toothless portion 210*c* and the third toothless portion 220*c* in this example, for enabling the driving finger 233 to air-swing with respect to either the date indicator 210 or 220, to thereby stop one of the first date indicator 210 and the second date indicator 220, so that the other date indicator alone is driven, depending on whether or not the toothless portions 210*c*, 220*c* provided on the toothed portion 210*a* of the first date indicator 210 or the toothed portion 220*a* of the second date indicator 220, respectively, is located within the drive track of the driving finger 233.

The engagement state switching means has concurrent drive means for concurrently driving the first date indicator 210 and the second date indicator 220 to thereby move the toothless portions 210*c*, 220*c*, located in the drive track of the driving finger 233. The concurrent drive means causes the projection 224 of the second date indicator 220 to be engaged with the arc groove 212 of the first date indicator 210 to thereby concurrently feed the date indicators 210, 220 by utilizing the pressing/pulling relationship between the groove walls 214*a*, 214*b* of the arc groove 212 and the projection 224. It should be noted that although the arc groove 212 is formed on the first date indicator 210 and the projection 224 is formed on the second date indicator 220 in this example, the arc groove 212 may be formed on the second date indicator 220 and the projection 224 may be formed on the first date indicator 210.

(3) In the following, with reference to FIGS. 16 to 19, a basic operation of the first date indicator 210, the second date indicator 220, and the date indicator drive control portion (the date indicator driving mechanism in this example) 230M will be described.

As shown in FIGS. 17 and 18, with the second date indicator (the upper date indicator) 220 in a normal driving state, the date indicator driving wheel 230 receives a driving force from the hour wheel 205 rotating in the direction indicated by the arrow C2, and thus rotates in the direction indicated by the arrow B2. The driving finger (the date dial driving finger) 233, mounted on the date indicator driving wheel 230, also rotates in the direction B2. With the second date indicator (the upper date indicator) 220 in a normal driving state, as the driving finger 233 air-swings with respect to the first toothless portion 210*c* of the toothed portion 210*a* of the first date indicator 210, only the toothed portion 220*a* of the second date indicator (the upper date indicator) 220 is sequentially fed by the driving finger 233 from the date $1^{st}$ to the date $15^{th}$. Switching the dates from the date $15^{th}$ to the date $16^{th}$ and from the date $16^{th}$ to the date $17^{th}$ will be described later.

As shown in FIG. 19, with the first date indicator (the lower date indicator) 210 in a normal driving state, the date indicator driving wheel 230 receives a driving force from the hour wheel 205 rotating in the direction C2, and thus rotates in the direction B2. The driving finger (the date dial driving finger) 233, mounted on the date indicator driving wheel 230, also rotates in the direction B2. With the first date indicator (the lower date indicator) 210 in a normal driving state, as the driving finger 233 air-swings with respect to the third toothless portion 220*c* of the toothed portion 220*a* of the second date indicator 220, only the toothed portion 210*a* of the first date indicator (the upper date indicator) 210 is sequentially fed by the driving finger 233 from the date $17^{th}$ to the date $31^{st}$. Switching the dates from the date $31^{st}$ to the date $1^{st}$ will be described later.

(4) In the following, with reference to FIGS. 20 to 24, operations of the first date indicator 210, the second date indicator 220, and the date indicator drive control portion (the date indicator driving mechanism in this example) 230M will be described in detail.

Figure 20:
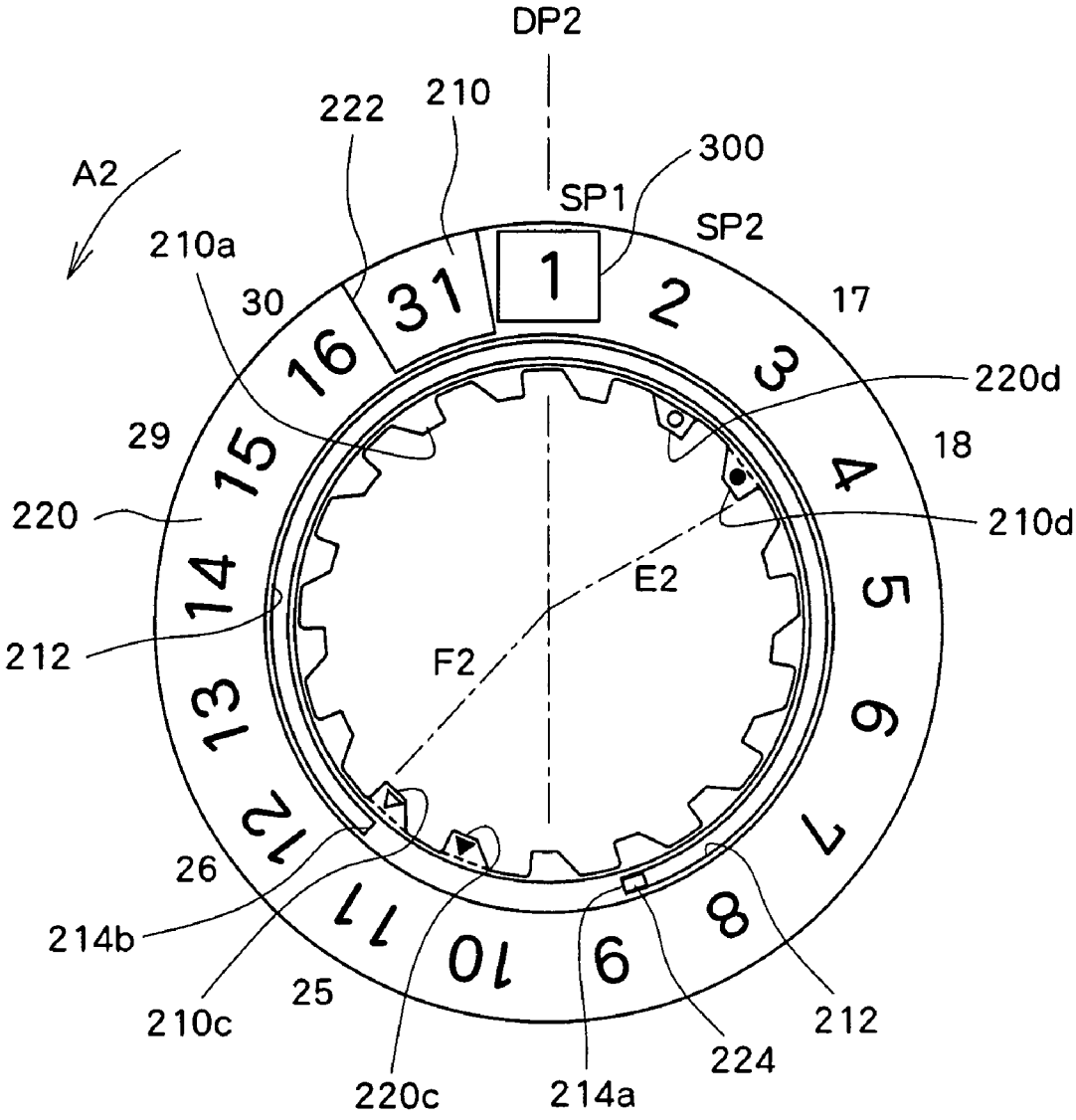
FIG. 20 is a schematic plan view explaining a date indicator of the timepiece calendar device shown in FIG. 16 in a normal driving state, showing the date $1^{st}$ on display and schematically showing the state of the concurrent drive means.
Figure 21:
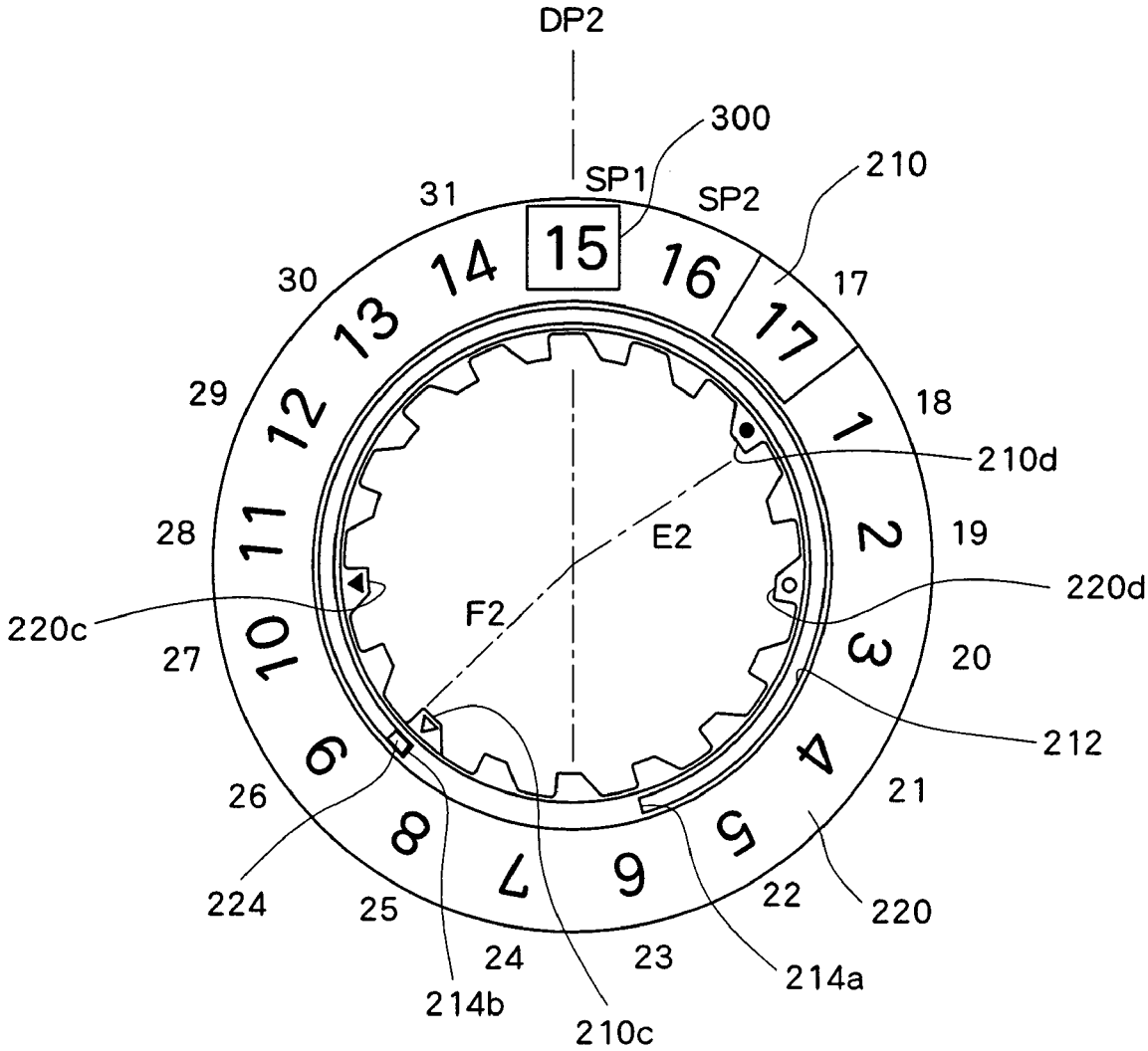
FIG. 21 is a schematic plan view explaining a date indicator of the timepiece calendar device shown in FIG. 16 in a normal driving state, showing the date $15^{th}$ on display and schematically showing the state of the concurrent drive means.
Figure 22:
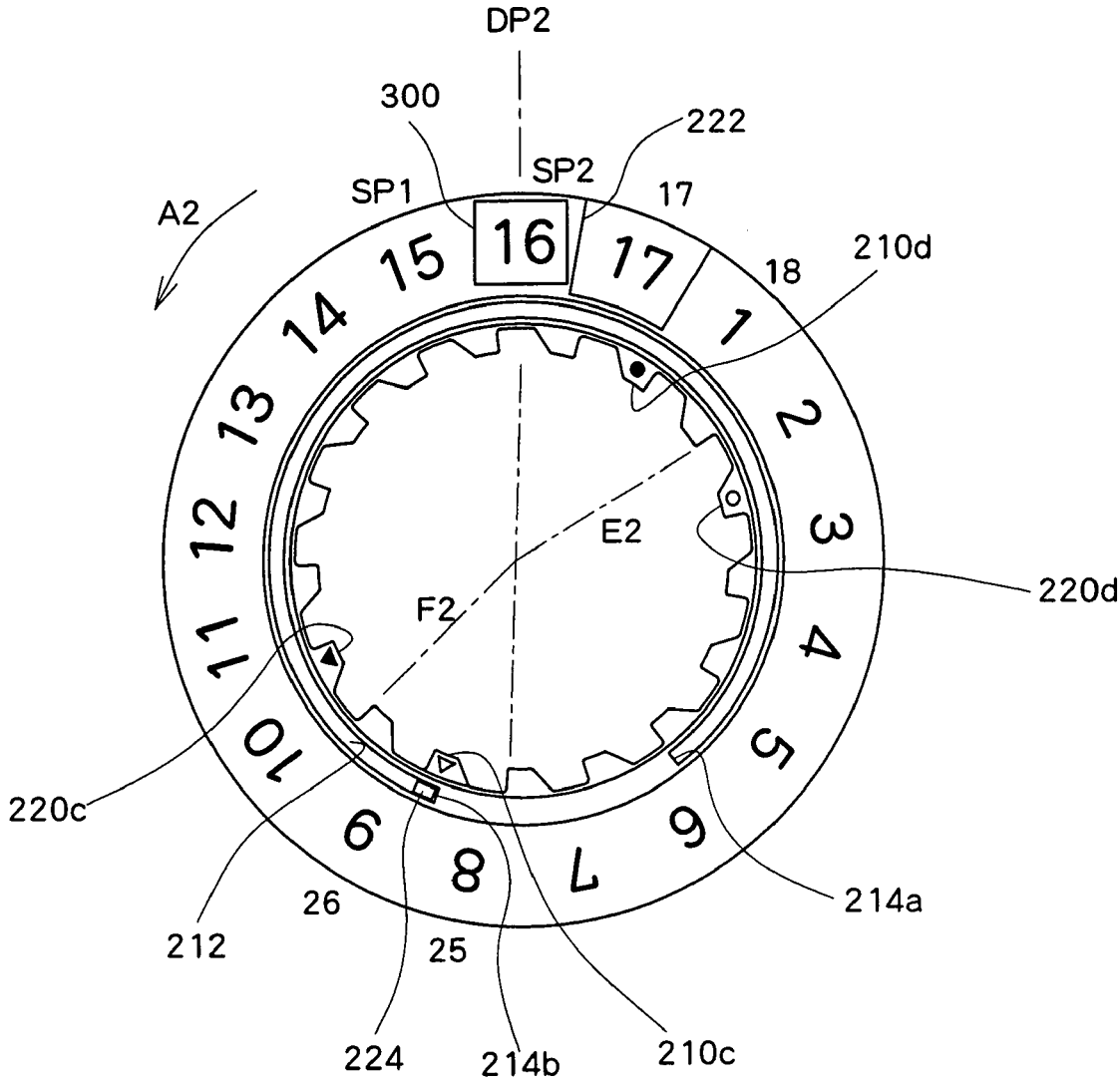
FIG. 22 is a schematic plan view explaining a date indicator of the timepiece calendar device shown in FIG. 16 in a normal driving state, showing the date $16^{th}$ on display and schematically showing the state of the concurrent drive means.
Figure 23:
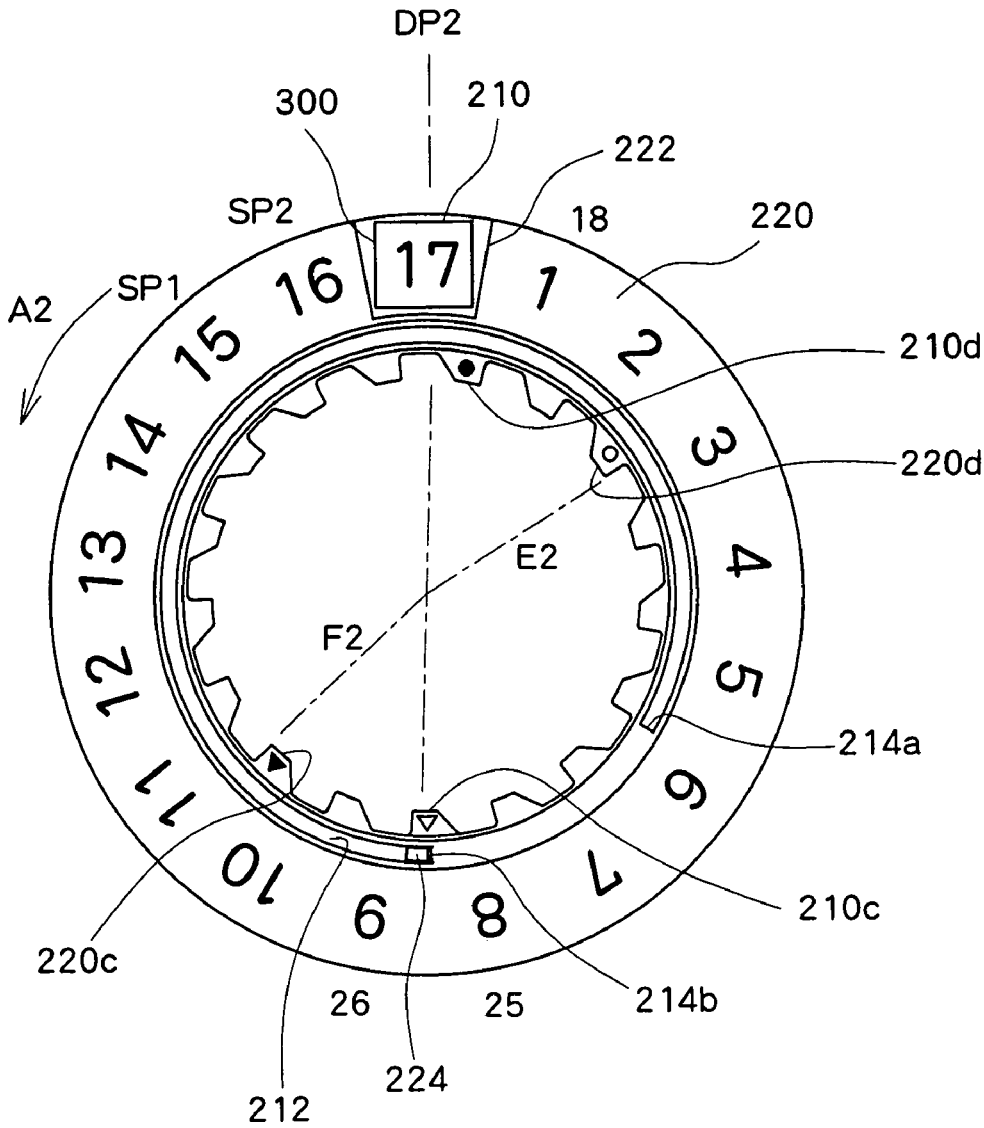
FIG. 23 is a schematic plan view explaining a date indicator of the timepiece calendar device shown in FIG. 16 in a normal driving state, showing the date $17^{th}$ on display and schematically showing the state of the concurrent drive means.
Figure 24:
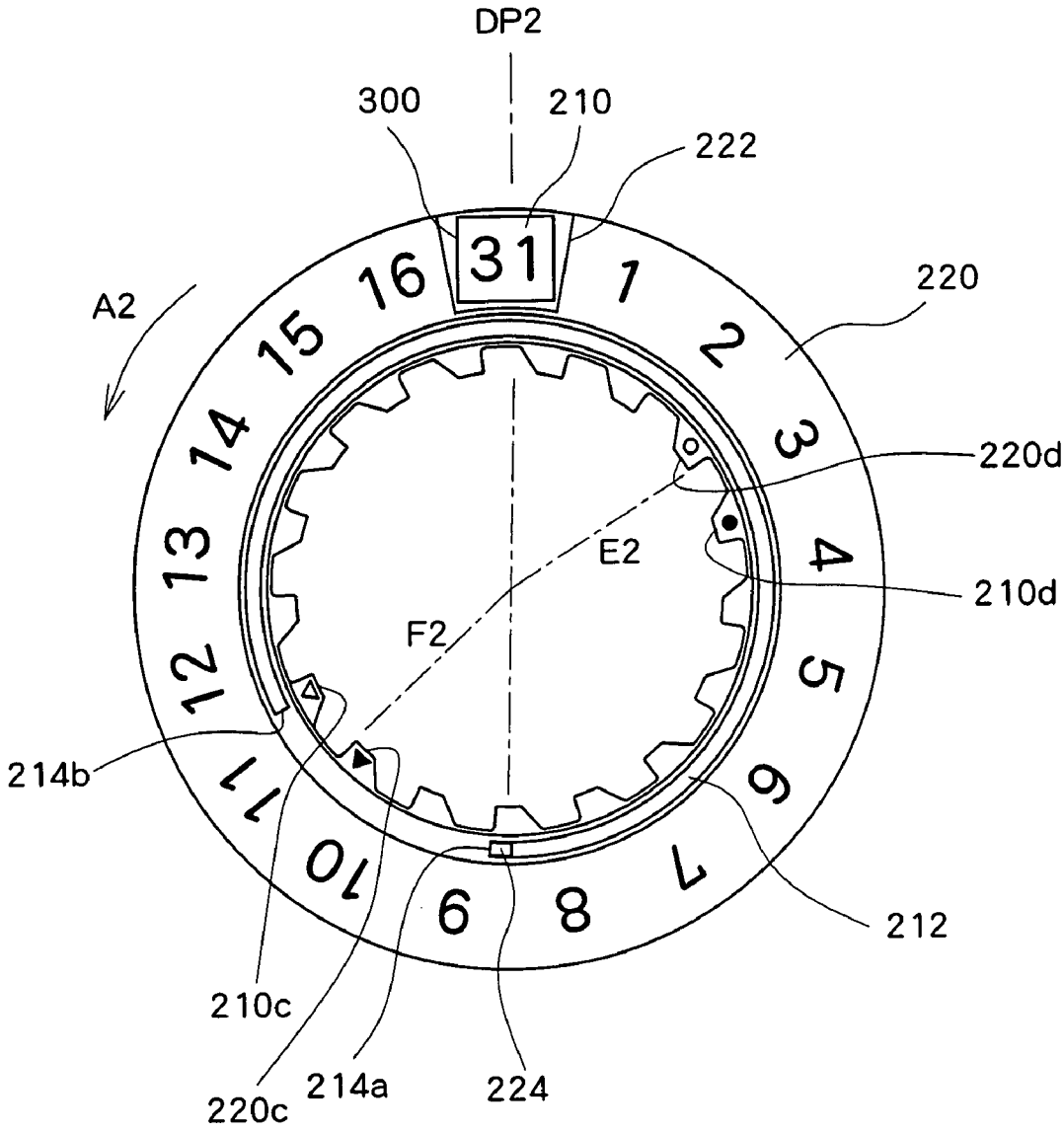
FIG. 24 is a schematic plan view explaining a date indicator of the timepiece calendar device shown in FIG. 16 in a normal driving state, showing the date $31^{st}$ on display and schematically showing the state of the concurrent drive means.

In FIGS. 20 to 24, the dial is removed except for the window 300. The drawings are plan views explaining the date indicator in a normal driving state. FIG. 20 shows the date $1^{st}$ on display. FIG. 21 shows the date $15^{th}$ on display; FIG. 22 shows the date $16^{th}$ on display; and FIG. 23 shows the date $17^{th}$ on display. FIG. 24 shows the date $31^{st}$ on display. The display window 300 on the dial is located in the position DP2 of 12 o'clock in the upper portion in the drawing as this is the second embodiment shown in FIG. 16. In the respective drawings, the state of the concurrent driving means is schematically shown, and the positions of the arc groove 212 defined on the first date indicator (the lower date indicator) 210 and the groove walls 214*a*, 214*b* formed where the groove is disconnected are shown. In addition, the projection 224 to be engaged with the arc groove 212 formed on the second date indicator (the upper date indicator) 220 is also shown in the respective drawings.

The positions where the driving finger (the date indicator driving finger in this example) is engaged with the toothed portions 210*a*, 220*a* of the date indicators 210, 220 are indicated by the line F2. The positions where the correction finger 253 of the corrector setting wheel 250 is engaged with the toothed portions 210*a*, 220*a* of the date indicators 210, 220 are indicated by the line E2. In the respective drawings, the positions of the first toothless portion 210*c* (a white triangle Δ is attached to the position of the first toothless portion in FIGS. 20 to 24) and the second toothless portion 210*d* (a black circle ● is attached to the position of the second toothless portion in the same drawings), both formed in the toothed portion 210*a* of the first date indicator 210, are shown. Further, in the respective drawings, the positions of the third toothless portion 220*c* (a black triangle ▲ is attached to the position of the third toothless portion in the same drawings) and the fourth toothless portion 220*d* (a white circle ○ is attached to the position of the fourth toothless portion in the same drawings), both formed in the toothed portion 220*a* of the second date indicator 220, are shown.

Here, the first toothless portion 210*c* and the third toothless portion 220*c* are toothless portions for date feeding; the second toothless portion 210*d* and the fourth toothless portion 220*d* are toothless portions for correction. As shown in FIG. 18, the first toothless portion 210*c* is formed such that a part of the toothed portion 210*a* of the first date indicator 210 on the upper surface side is removed in the width direction, leaving a thin toothed portion. As shown in FIG. 19, the third toothless portion 220*c* is formed such that a part of the toothed portion 220*a* of the second date indicator 220 is removed on the lower surface side in the width direction, leaving a thin toothed portion. As shown in FIG. 26, the second toothless portion 210*d* is formed such that a part of the toothed portion 210*a* of the first date indicator 210 is removed on the lower surface side in the width direction, leaving a thin toothed portion. As shown in FIG. 27, the fourth toothless portion 220*d* is formed such that a part of the toothed portion 220*a* of the second date indicator 220 is removed on the upper surface side in the width direction, leaving a thin toothed portion.

The first toothless portion 210*c* relates to stopping of the first date indicator 210 when normally driving the date dial; the second toothless portion 210*d* relates to stopping of the first date indicator 210 when correcting the dates.

The third toothless portion 220*c* relates to stopping of the second date indicator 220 in normally driving the date dial; the fourth toothless portion 220*d* relates to stopping of the second date indicator 220 when correcting the dates.

The arrow A2 indicates the rotation direction of the date indicators 210, 220. In FIGS. 20 to 24, the date denotations in the denotation portion 220*b* of the second date indicator 220 are described as is, and with respect to the date denotations in the denotation portion 210*b* of the first date indicator 210, the date denotation exposed in the opening 222 is described as is, and other date denotations are described in smaller numbers around the wheel.

In FIG. 20, showing the date $1^{st}$ on display, the denotation of the date $1^{st}$ on the second date indicator 220 appears in the display window 300. In the above, the information-free portion (the space portion) SP1 of the first date indicator 210 is located below the denotation of the date $1^{st}$ on the second date indicator 220, located in the display window 300. In the above, the first toothless portion 210*c* of the first date indicator 210 is located on the line F2, which corresponds to the date dial driving finger (the driving finger) 233. Therefore, in feeding to the next date, namely, the date $2^{nd}$, the first date indicator 210 is not fed by the driving finger 233, which, instead, air-swings with respect to the first toothless portion 210*c*, and drives only the toothed portion 220*a* of the second date indicator 220, so that the denotation of the date $2^{nd}$ appears in the display window 300. This operation in which the first date indicator 210 remains still and only the second date indicator 220 is driven for every day is continued until the date $15^{th}$, shown in FIG. 21.

In FIG. 21, showing the date $15^{th}$ on display, the denotation of the date $15^{th}$ appears in the display window 300, with the information-free portion (the space) SP1 on the first date indicator 210 located therebelow, not moving from the state shown in FIG. 20. Meanwhile, the groove wall 214*b* of the arc groove 212 is followed immediately by the projection 224.

The denotation for the next day, that is, the date $16^{th}$, is described on the second date indicator 220. As the toothed portion 220*a* of the second date indicator 220, which is then opposed to the driving finger 233, has a normal shape, rather than the third toothless portion 220*c*, the toothed portion 220*a* of the second date indicator 220 is driven by the driving finger 233, so that the denotation of the date $16^{th}$ appears in the display window 300. Simultaneously with the second date indicator 220 rotating, the projection 224 of the second date indicator 220 presses the groove wall 214*b* of the arc groove 212 of the first date indicator 210, whereby the first date indicator 210 moves in association with the second date indicator 220, resulting in the state shown in FIG. 22. That is, the information-free portion (the space portion) SP2 on the first date indicator 210 comes to be located below the denotation of the date $16^{th}$ on the second date indicator 220.

In FIG. 22, the first toothless portion 210*c* of the first date indicator 210 advances to the position ahead by one tooth of the line F2, and the third toothless portion 220*c* advances to the position short by one tooth of the line F2. Also, the opening 222 on the first date indicator 210 advances to the position short by one tooth of the display window 300.

In feeding to the next day, that is, the date $17^{th}$, the normal toothed portion 210*a* of the first date indicator 210 and the normal toothed portion 220*a* of the second date indicator 220 are driven by the driving finger 233, whereby, similar to the feeding from the date $15^{th}$ to the date $16^{th}$, the projection 224 of the second date indicator 220 presses the groove wall 214*b* of the arc groove 212 of the first date indicator 210, whereby the first date indicator 210 moves in association. As described above, the denotation of the date $17^{th}$ is displayed, shown in FIG. 23.

In the second embodiment, the first date indicator 210 and the second date indicator 220 are concurrently driven three times, or the number obtained by adding one to the number of the information-free portions, namely, two.

In FIG. 23, showing the date $17^{th}$ on display, the opening 222 of the second date indicator 220 is located below the display window 300, so that the denotation of the date $17^{th}$ on the first date indicator 210 is shown in the display window 300 through the opening 222. The first toothless portion 210*c* of the first date indicator 210 is located displaced by two days relative to the position of the line F2, which is opposed to the driving finger (the date dial driving finger) 233. Therefore, the normal toothed portion 210*a* of the first date indicator 210 is in a state ready to be engaged with the driving finger 233, or a state in which the toothed portion 210*a* of the first date indicator 210 is driven by the driving finger 233. Meanwhile, the third toothless portion 220*c* of the second date indicator 220 is located at the position of the line F2, which is opposed to the driving finger 233.

Therefore, feeding to the next day, that is, the date $18^{th}$, is carried out by only the driving finger 233 driving the toothed portion 210*a* of the first date indicator 210, and the second date indicator 220 is not fed, with the opening 222 remaining in the current position in FIG. 23. Also, in the above, as the second date indicator 220 remains not moving, the projection 224 also does not move, while the first date indicator 210 advances, with the groove wall 214*b* of the arc groove 212 separated from, so as to be ahead of, the projection 224.

This operation for shifting from the date $17^{th}$ to the date $18^{th}$, in which the second date indicator 220 remains still and only the first date indicator 210 is driven for every day, is continued until the date $31^{st}$, shown in FIG. 24.

FIG. 24 shows the date $31^{st}$ on display. The opening 222 of the second date indicator 220 remains below the display window 300, and the denotation of the date $31^{st}$ on the first date indicator 210 is exposed in the display window 300 through the opening 222.

In this state, the first toothless portion 210*c* of the toothed portion 210*a* of the first date indicator 210 is located short by one tooth of the line F2, and the driving finger is located in the third toothless portion 220*c*. Therefore, the second date indicator 220 remains still and only the first date indicator 210 is driven for one day by the driving finger 233. However, concurrently, the groove wall 214*a* of the arc groove 212 of the first date indicator 210 presses the projection 224 of the second date indicator 220; the first date indicator 210 and the second date indicator 220 thus rotate; and the date on display shifts from the date $31^{st}$, shown in FIG. 24, to the date $1^{st}$, shown in FIG. 20. As described above, circulation display is carried out every month. It should be noted that, in a short month, the fact that the date $31^{st}$ is not used is compensated for by advancing the timepiece hand or using the date correction mechanism.

Figure 28:
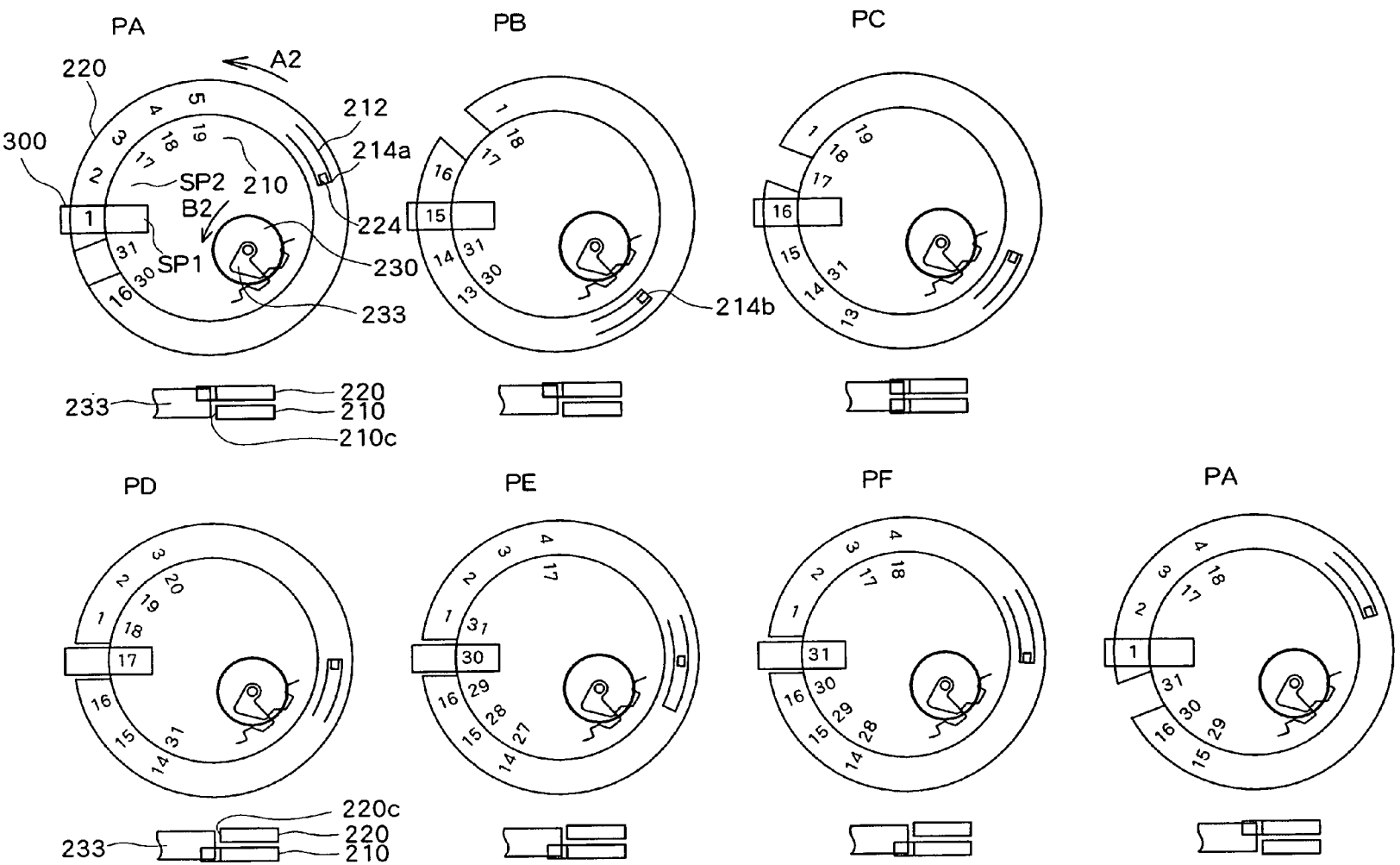
FIG. 28 is a diagram explaining principle of an operation of the calendar in the timepiece calendar device in the second embodiment.

The description with reference to FIGS. 20 to 24 will be readily understood with reference to the detailed list in FIG. 28, or the drawing which explains the principle of the operation for displaying a calendar in the second embodiment.

FIG. 28 schematically shows the circulation of the date denotation from the position PA, to PB, PC, PD, PE, PF, PA. In the respective positions, the denotations of the dates on the first date indicator are described inside the wheel, while those on the second date indicator are described between the larger and smaller wheels. The denotation shown in the window on the dial in the respective position is described within the frame of the window 300.

The relationship between the groove walls 214*a*, 214*b* of the arc groove 212 and the projection 224 is illustrated between the larger and smaller wheels in the respective positions. The engagement relationship between the driving finger (the date dial driving finger) 233 and the toothed portions 210*a*, 220*a* of the first date indicator 210 and the second date indicator 220, respectively, are illustrated in the space below the respective cross sectional views, with the first toothless portion 210*c* and the second toothless portion 220*c* particularly focused on.

For backward rotation (reverse rotation) of the timepiece hand for correction, the driving finger (the date dial driving finger) 233 has a slope portion on the rear side of the finger in the direction opposite from the feeding direction, and a notch 233*f* for enabling the tip end of the finger to flex (shown in FIGS. 16 and 17), so that the slope surface and the flexure make it possible for the driving finger (the date dial driving finger) 233 to escape, preventing the first date indicator 210 and the second date indicator 220 from rotating backward.

(5) Structure of Date Correction Mechanism 250M

Figure 25:
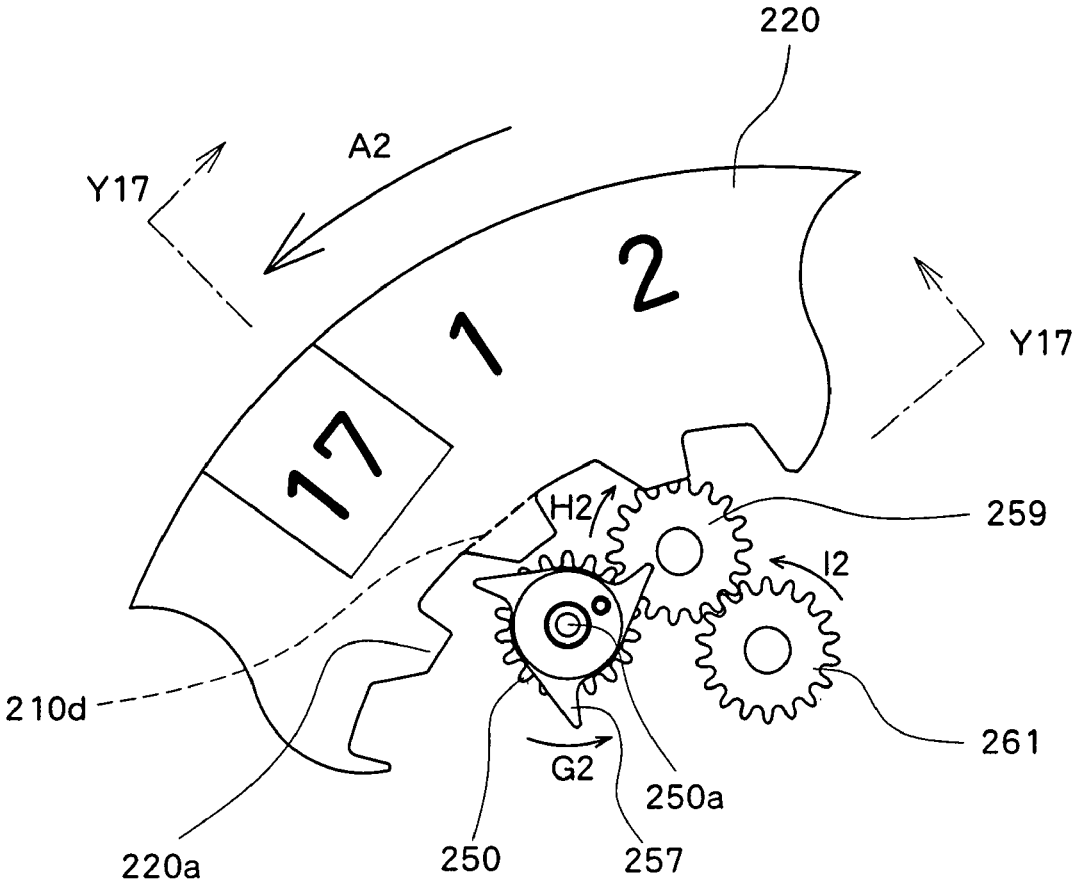
FIG. 25 is a partial plan view of a timepiece calendar device shown in FIG. 16, showing the second date indicator (the upper date indicator) in a correction state.

In the following, with reference to FIG. 16 and FIGS. 25 to 27, the structure of the date correction mechanism 250M in this embodiment will be described. FIG. 25 is a partial plan view of the timepiece calendar device in FIG. 16, showing the second date indicator (the upper date indicator) 220 in a correction state. FIG. 26 is a cross sectional view along the line Y17-Y17 in FIG. 25.

The date correction mechanism 250M comprises a corrector setting wheel 250, a date corrector setting transmission wheel III 263, a date corrector setting transmission wheel II 261, and a date corrector setting transmission wheel I 259 for transmitting a correction rotational force from the crown 206 via the hand setting stem 206*a*. The corrector setting wheel 250 fixedly holds the date corrector finger 253. The date corrector finger 253 comprises a third driving finger 255 for correctively driving the toothed portion 210*a* of the first date indicator 210 and a fourth driving finger 257 for correctively driving the toothed portion 220*a* of the second date indicator 220, and is integrally driven for rotation around the shaft 250*a* fixed to the substrate (a main plate in this example) 203.

The third driving finger 255 and the fourth driving finger 257 have an identical shape in a plan view. The corrector setting wheel 250 is stably held fitted to the shaft 250*a* and being pressed on the upper side thereof by the holder plate 204. The shaft 250*a* for the corrector setting wheel 250 is not held in the manner of sliding in the long hole in this example, and escapes from the date indicator rotating by the date indicator driving mechanism 230M, by utilizing a mechanism in which the corrector setting wheel 250 freely rotates as the date corrector setting transmission wheel III 263 remains disengaged with the date corrector setting transmission wheel II 261 at any time other than when transmitting a correction rotational force via the hand setting stem 206*a*.

The toothed portion 210*a* of the first date indicator 210, which is located in the drive path of the third driving finger 255 corresponding to a predetermined period of time in which the fourth driving finger 257 drives, for correction, the toothed portion 220*a* of the second date indicator 220, is provided with a second toothless portion 210*d* for avoiding engagement with the third driving finger 255. Due to the presence of the second toothless portion 210*d*, the third driving finger 255 makes an air-swing. Also, the toothed portion 220*a* of the second date indicator 220, which is located in the drive path of the fourth driving finger 257 corresponding to a predetermined period of time in which the third driving finger 255 drives, for correction, the toothed portion 210*a* of the first date indicator 210, is provided with a fourth toothless portion 220*d* for avoiding engagement with the fourth driving finger 257. Due to the presence of the fourth toothless portion 220*d*, the fourth driving finger 257 makes an air-swing.

Figure 26:
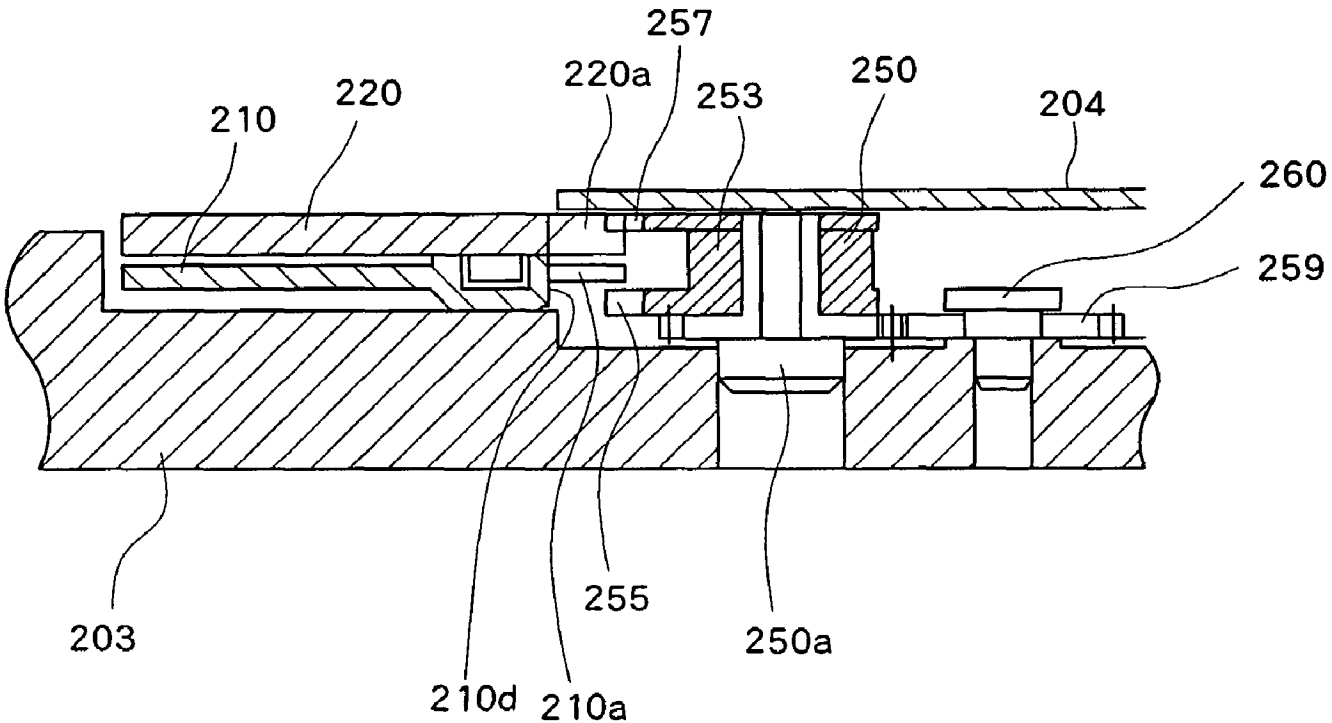
FIG. 26 is a cross sectional view along the line Y17-Y17 in FIG. 25, showing the second date indicator in a correction state.
Figure 27:
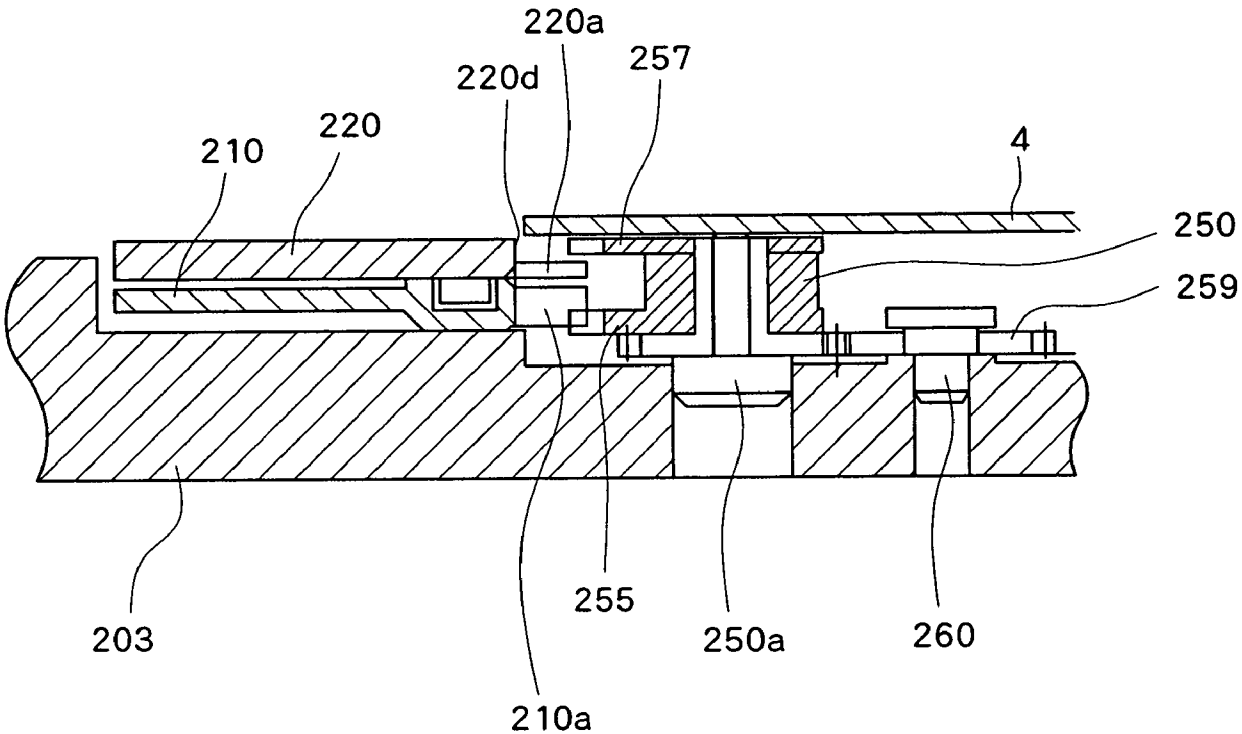
FIG. 27 is a cross sectional view of the first date indicator (the lower date indicator) in a correction state, similar to FIG. 26.

As described above, the second toothless portion 210*d* has a toothed portion 210*a* of the first date indicator 210 having teeth removed on the lower surface side thereof and teeth present on the upper surface side thereof, as shown in FIG. 26; the fourth toothless portion 220*d* has a toothed portion 220*a* of the second date indicator 220 having teeth removed on the upper surface side thereof and teeth present on the lower surface side thereof, as shown in FIG. 27.

(6) In the following, an operation of the date correction mechanism 250M will be described.

The corrector setting wheel 250, the date corrector setting transmission wheel I 259, and the date corrector setting transmission wheel II 261 rotate via the crown 206, the hand setting stem 206*a*, and the date corrector setting transmission wheel III 263 in the directions indicated by the arrows G2, H2, I2, respectively, shown in FIGS. 16 and 25. In FIGS. 25 and 26, the second toothless portion 210*d* of the first date indicator 210 is located opposed to the third driving finger 255.

Therefore, from the date $1^{st}$ to the date $15^{th}$, the fourth driving finger 257 sequentially feeds the second date indicator 220 alone in the direction indicated by the arrow A2 in FIG. 25. This state is shown in FIGS. 20 and 21. With the denotation of the date $15^{th}$ shown, the projection 224 on the rear surface of the second date indicator 220 presses the groove wall 214*b* of the arc groove 212 of the first date indicator 210, so that the date indicators 210, 220 are both fed in association. With the above, as shown in FIGS. 22 and 23, date feeding from the date $15^{th}$ to the date $16^{th}$ further to the date $17^{th}$ is carried out. In FIG. 23, the second toothless portion 210*d* moves, and the normal toothed portion 210*a* of the first date indicator 210 comes to be located where the second toothless portion 210*d* is located thus far. Then, as the fourth toothless portion 220*d* of the second date indicator 220 comes to be opposed to the fourth driving finger 257, the third driving finger 255 sequentially feeds the toothed portion 210*a* of the first date indicator (the lower date indicator) 210 from the date $17^{th}$ to the date $31^{st}$. On the date $31^{st}$, shown in FIG. 24, although the fourth toothless portion 220*d* remains opposed to the fourth driving finger 257, as the normal toothed portion 210*a* of the first date indicator 210 is opposed to the third driving finger 255, only the first date indicator 210 is fed when feeding to the next day, namely, the date $1^{st}$. However, as the projection 224 on the rear surface of the second date indicator 220 is pressed by the groove wall 214*a* of the arc groove 212 of the first date indicator 210, the date indicators 210, 220 are both fed in association. As described above, the denotation of the date $1^{st}$ comes to be shown again, as shown in FIG. 20. As described above, the date correction also circulates.

In the above-described first and second embodiments, a structure of a date correction mechanism in which the date indicator drive control portions (the date indicator driving mechanism) 30M, 230M do not interfere with the date correction mechanisms 50M, 250M is obtained, and the mutual positional relationship is not limited to a particular position when the positional relationship with respect to the toothed portion is matched.

In the above, it is described that the first to fourth toothless portions 10*c*, 10*d*, 20*c*, 20*d*, 210*c*, 210*d*, 220*c*, 220*d* are thin toothed portions where the toothed portions 10*a*, 20*a*, 210*a*, 220*a* are partially removed in the width direction, but these may be toothless portions with the teeth removed in the entire area.

Although it is described that the toothed portions 10*a*, 20*a* each have sixteen teeth in the first embodiment and the toothed portions 210*a*, 220*a* each have seventeen teeth in the second embodiment, seventeen or more teeth may be formed on the date indicator. For example, in the case of eighteen teeth, the first date indicator (the lower date indicator) may have denotations of the dates from $18^{th}$ to $31^{st}$ and four information-free portions, and the second date indicator (the upper date indicator) may have denotations of the dates from $1^{st}$ to $17^{th}$ and an opening. In this case, the date indicators are concurrently driven five times.

Although examples in which the toothed portions 10*a*, 20*a*, 210*a*, 220*a* have sixteen, seventeen, and eighteen teeth are described in the above, the display wheel having three or more teeth is applicable to the present invention.

In the above, although a timepiece calendar device is described as an example of a display device, the present invention is applicable to, for example, a display device for displaying information, such as mode switch information, day of the week, lunar age, am/pm, or city names in a world clock, using a rotating display wheel.

INDUSTRIAL APPLICABILITY

As described above, the display device and the timepiece calendar device according to the present invention are useful for showing the letters and numbers of a display device in large size, and in particular can be utilized in a display device, such as a display device, a wrist timepiece, and a small clock, or the like, where denotation is often small.

The invention claimed is:

1. A display device, comprising:

a first display wheel having a denotation portion for showing information about a part of a period and a toothed portion including a plurality of teeth to be driven;

a second display wheel having a denotation portion for showing a part of the period other than the part of the period shown by the first display wheel, an opening via which the first display wheel is exposed, and a toothed portion including a plurality of teeth to be driven, and placed overlapping the first display wheel; and a driving finger for driving the first display wheel and the second display wheel to rotate, and further comprising:

a display wheel drive control portion for driving the first display wheel and the second display wheel, using the driving finger, every predetermined period of time, to thereby expose the denotation portion on one of the display wheels in a window to thereby display the information, wherein numbers of teeth in the toothed portions of the first display wheel and of the second display wheel are the same, the display wheel drive control portion comprises, engagement state generation means for generating a first engagement state in which the driving finger is engaged with the toothed portion of the first display wheel but not with the toothed portion of the second display wheel when the denotation portion on the first display wheel displays the information about the part of the period in the window through the opening on the second display wheel, and for generating a second engagement state in which the driving finger is engaged with the toothed portion of the second display wheel but not with the toothed portion of the first display wheel when the denotation portion on the second display wheel displays the information about the other period in the window, and engagement state switching means for switching engagement states of the driving finger relative to the toothed portion of the first display wheel and the toothed portion of the second display wheel to thereby mutually switch the first engagement state and the second engagement state, the engagement state generation means is formed by an air swing generation portion for enabling the driving finger to air-swing with respect to one of the display wheels depending on whether or not a toothless portion formed on the toothed portion of at least one of the first display wheel and the second display wheel is located within a drive track of the driving finger, to thereby stop one of the first display wheel and the second display wheel, and drives only other display wheel, and the toothless portion is a thin portion with the tooth partially removed in a thickness direction of the toothed portion.

2. The display device according to claim 1, wherein the engagement state switching means has concurrent drive means for concurrently driving the first display wheel and the second display wheel to thereby move the thin tooth portion located within the drive track of the driving finger.

3. The display device according to claim 2, wherein the concurrent drive means includes a projection and a groove to be engaged with the projection, the projection and the groove being formed on the respective display wheels.

4. The display device according to claim 1, wherein the toothed portion of the first display wheel includes seventeen teeth, the denotation portion on the first display wheel has denotations of dates $17^{th}$ to $31^{st}$ and two information-free portions successively formed between the dates $17^{th}$ and $31^{st}$, the toothed portion of the second display wheel includes seventeen teeth, the denotation portion of the second display wheel has denotations of dates $1^{st}$ to $16^{th}$ and an opening formed between the dates $1^{st}$ and $16^{th}$, the second display wheel alone is driven by the driving finger in feeding from the date $1^{st}$ to the date $15^{th}$, the first display wheel and the second display wheel are concurrently driven in feeding from the date $15^{th}$ to the date $16^{th}$ and the date $16^{th}$ to $17^{th}$, the first display wheel alone is driven by the driving finger in feeding from the date $17^{th}$ to the date $31^{st}$, and the first display wheel and the second display wheel are concurrently driven in feeding from the date $31^{st}$ to the date $1^{st}$.

5. The display device according to claim 4, wherein a number of applications of concurrent driving by the concurrent drive means is a number obtained by adding one to a number of information-free portions.

6. The display device according to claim 1, wherein the driving finger has a first driving finger for driving the toothed portion of the first display wheel and a second driving finger for driving the toothed portion of the second display wheel, and the engagement state generation means is path switching means for causing the second driving finger to be displaced from a drive path to avoid engagement between the toothed portion of the second display wheel and the second driving finger, when the first driving finger drives the toothed portion of the first display wheel.

7. The display device according to claim 6, wherein the first driving finger and the second driving finger are driving fingers at least one of which has an abutment portion to abut on the toothed portion, and the path switching means is a timepiece component which appears within a driving area of the driving finger during a predetermined period of time in which the toothed portion of the first display wheel is driven and contacts the abutment portion of the driving finger to thereby switch the drive path of the second driving finger to an avoidance path.

8. The display device according to claim 7, wherein the timepiece component is the toothed portion of the first display wheel.

9. The display device according to claim 7, wherein the toothed portion of the first display wheel, which is located in the drive path of the first driving finger corresponding to a predetermined period of time in which the second driving finger drives the toothed portion of the second display wheel, is provided with a toothless portion for enabling air-swing with respect to the toothed portion to avoid engagement with the first driving finger.

10. The display device according to claim 9, wherein the abutment portion of the first driving finger is fitted into the toothless portion, whereby the second driving finger is located in the drive path for engagement with the toothed portion of the second display wheel.

11. The display device according to claim 7, wherein the driving finger has a long hole for enabling a predetermined shaft to change a rotational center position thereof, and is urged by a spring member toward the toothed portions of the first display wheel and the second display wheel.

12. The display device according to claim 6, wherein the first driving finger and the second driving finger are integrally formed.

13. The display device according to claim 6, wherein the toothed portion of the first display wheel and the toothed portion of the second display wheel are formed so as to rotate along substantially identical paths, the first driving finger and the second driving finger are formed so as to integrally drive for rotation around a predetermined rotational center as a reference, and an engagement portion of the first driving finger is positioned closer to the toothed portion of the display wheel than an engagement portion of the second driving finger.

14. The display device according to claim 6, wherein the toothed portion of the first display wheel and the toothed portion of the second display wheel are formed so as to rotate along substantially identical paths, the first driving finger and the second driving finger are formed so as to integrally drive for rotation around a predetermined rotational center as a reference, and a length from the predetermined rotational center to an engagement portion of the first driving finger is defined longer than a length from the predetermined rotational center to an engagement portion of the second driving finger.

15. The display device according to claim 1, further comprising a corrector setting wheel having a driving finger for correctively driving the toothed portion of the display wheel.

16. The display device according to claim 15, wherein the driving finger of the corrector setting wheel includes a third driving finger for correctively driving the toothed portion of the first display wheel and a fourth driving finger for correctively driving the toothed portion of the second display wheel, and is formed integrally driving for rotation around a predetermined rotational center as a reference, in which an engagement portion of the third driving finger is positioned closer to the toothed portion of the display wheel than an engagement portion of the fourth driving finger.

17. The display device according to claim 16, wherein the toothed portion of the first display wheel, which is located in the drive path of the third driving finger corresponding to a predetermined period of time during which the fourth driving finger correctively drives the toothed portion of the second display wheel, is provided with a toothless portion for avoiding engagement with the third driving finger.

18. The display device according to claim 17, wherein the abutment portion of the third driving finger is inserted into the toothless portion whereby the fourth driving finger is introduced into the drive path for engagement with the toothed portion of the second display wheel.

19. The display device according to claim 16, wherein an abutment portion to abut on the toothed portion is provided on at least one of the third driving finger and the fourth driving finger.

20. The display device according to claim 16, wherein the third driving finger and the fourth driving finger each have a reversal mechanism for enabling a predetermined shaft to change a rotational center position thereof.

21. The display device according to claim 16, wherein the first display wheel has a first toothless portion for avoiding engagement with the first driving finger and a second toothless portion for avoiding engagement with the third driving finger.

22. The display device according to claim 21, wherein the first toothless portion is formed on an upper surface side of the toothed portion of the first display wheel, and the second toothless portion is formed on a lower surface side of the toothed portion of the first display wheel.

23. The display device according to claim 22, wherein the toothed portion of the first display wheel includes sixteen teeth, the denotation portion on the first display wheel has denotations of dates $16^{th}$ to $31^{st}$, the toothed portion of the second display wheel includes sixteen teeth, the denotation portion of the second display wheel has denotations of dates $1^{st}$ to $15^{th}$ and the opening formed between the dates $1^{st}$ and $15^{th}$, the first driving finger air-swings with respect to the first toothless portion of the first display wheel and the second driving finger drives only the second display wheel in feeding from the date $1^{st}$ to the date $15^{th}$, the concurrent drive means concurrently drives the first display wheel and the second display wheel in feeding from the date $15^{th}$ to the date $16^{th}$, the abutment portion abuts on the toothed portion of the first display wheel, so that the second driving finger is apart from the toothed portion of the second display wheel, and only the first display wheel is driven by the first driving finger, in feeding from a date $17^{th}$ to a date $31^{st}$, and the abutment portion and the first driving finger are inserted into the first toothless portion and only the second display wheel is driven by the second driving finger in feeding from the date $31^{st}$ to the date $1^{st}$.

24. The display device according to claim 22, wherein the toothed portion of the first display wheel includes sixteen teeth, the denotation portion on the first display wheel has denotations of a date $16^{th}$ to a date $31^{st}$, the toothed portion of the second display wheel includes sixteen teeth, the denotation portion of the second display wheel has denotations of a date $1^{st}$ to a date $15^{th}$ and the opening formed between the date $1^{st}$ and the date $15^{th}$, the third driving finger air-swings with respect to the second toothless portion, and the fourth driving finger drives only the second display wheel in correction from the date $1^{st}$ to the date $15^{th}$, the concurrent drive means concurrently drives the first display wheel and the second display wheel in correction from the date $15^{th}$ to the date $16^{th}$, the abutment portion abuts on the toothed portion of the first display wheel, so that the fourth driving finger is apart from the toothed portion of the second display wheel, and only the first display wheel is driven by the third driving finger, in correction from the date $17^{th}$ to the date $31^{st}$, and the abutment portion and the third driving finger are inserted into the second toothless portion and only the second display wheel is driven by the fourth driving finger in correction from the date $31^{st}$ to the date $1^{st}$.

25. The display device according to claim 15, wherein the driving finger of the corrector setting wheel includes a third driving finger for correctively driving the toothed portion of the first display wheel and a fourth driving finger for correctively driving the toothed portion of the second display wheel, and is integrally and rotatably formed driving for rotation around a predetermined rotational center as a reference, in which a length from the predetermined rotational center to an engagement portion of the third driving finger is defined longer than a length from the predetermined rotational center to an engagement portion of the fourth driving finger.

26. The display device according to claim 25, wherein the toothed portion of the first display wheel, which is located in the drive path of the third driving finger corresponding to a predetermined period of time during which the fourth driving finger correctively drives the toothed portion of the second display wheel, is provided with a toothless portion for avoiding engagement with the third driving finger.

27. The display device according to claim 26, wherein the abutment portion of the third driving finger is inserted into the toothless portion whereby the fourth driving finger is introduced into the drive path for engagement with the toothed portion of the second display wheel.

28. The display device according to claim 25, wherein an abutment portion to abut on the toothed portion is provided on at least one of the third driving finger and the fourth driving finger.

29. The display device according to claim 25, wherein the third driving finger and the fourth driving finger each have a reversal mechanism for enabling a predetermined shaft to change a rotational center position thereof.

30. The display device according to claim 25, wherein the first display wheel has a first toothless portion for avoiding engagement with the first driving finger and a second toothless portion for avoiding engagement with the third driving finger.

31. The display device according to claim 30, wherein the first toothless portion is formed on an upper surface side of the toothed portion of the first display wheel, and the second toothless portion is formed on a lower surface side of the toothed portion of the first display wheel.

32. The display device according to claim 31, wherein the toothed portion of the first display wheel includes sixteen teeth, the denotation portion on the first display wheel has denotations of a date $16^{th}$ to a date $31^{st}$, the toothed portion of the second display wheel includes sixteen teeth, the denotation portion of the second display wheel has denotations of a date $1^{st}$ to a date $15^{th}$ and the opening formed between the date $1^{st}$ and the date $15^{th}$, the third driving finger air-swings with respect to the second toothless portion, and the fourth driving finger drives only the second display wheel in correction from the date $1^{st}$ to the date $15^{th}$, the concurrent drive means concurrently drives the first display wheel and the second display wheel in correction from the date $15^{th}$ to the date $16^{th}$, the abutment portion abuts on the toothed portion of the first display wheel, so that the fourth driving finger is apart from the toothed portion of the second display wheel, and only the first display wheel is driven by the third driving finger, in correction from the date $17^{th}$ to the date $31^{st}$, and the abutment portion and the third driving finger are inserted into the second toothless portion and only the second display wheel is driven by the fourth driving finger in correction from the date $31^{st}$ to the date $1^{st}$.

33. The display device according to claim 31, wherein the toothed portion of the first display wheel includes sixteen teeth, the denotation portion on the first display wheel has denotations of dates $16^{th}$ to $31^{st}$, the toothed portion of the second display wheel includes sixteen teeth, the denotation portion of the second display wheel has denotations of dates $1^{st}$ to $15^{th}$ and the opening formed between the dates $1^{st}$ and $15^{th}$, the first driving finger air-swings with respect to the first toothless portion of the first display wheel and the second driving finger drives only the second display wheel in feeding from the date $1^{st}$ to the date $15^{th}$, the concurrent drive means concurrently drives the first display wheel and the second display wheel in feeding from the date $15^{th}$ to the date $16^{th}$, the abutment portion abuts on the toothed portion of the first display wheel, so that the second driving finger is apart from the toothed portion of the second display wheel, and only the first display wheel is driven by the first driving finger, in feeding from a date $17^{th}$ to a date $31^{st}$, and the abutment portion and the first driving finger are inserted into the first toothless portion and only the second display wheel is driven by the second driving finger in feeding from the date $31^{st}$ to the date $1^{st}$.

34. A timepiece calendar device, wherein the display device according to claim 1 is a timepiece calendar device.

* * * * *